US005634817A

United States Patent [19]

Siemon et al.

[11] Patent Number: 5,634,817

[45] Date of Patent: Jun. 3, 1997

[54] PATCH CONNECTOR

[75] Inventors: John A. Siemon, Woodbury; Robert C. Carlson, Jr., Torrington; Carl H. Weymouth, Riverton, all of Conn.

[73] Assignee: The Siemon Company, Watertown, Conn.

[21] Appl. No.: 488,126

[22] Filed: Jun. 7, 1995

Related U.S. Application Data

[63] Continuation-in-part of Ser. No. 144,768, Oct. 28, 1993, Pat. No. 5,460,545.

[51] Int. Cl.[6] ..... H01R 13/648

[52] U.S. Cl. ..... 439/608; 439/731

[58] Field of Search ..... 439/607, 608, 439/610, 404, 405, 409, 701, 731, 677, 680, 906

[56] References Cited

U.S. PATENT DOCUMENTS

| | | | |
|---|---|---|---|
| 3,798,587 | 3/1974 | Ellis, Jr. et al. . | |
| 4,435,035 | 3/1984 | Berry et al. | 439/731 X |
| 4,585,290 | 4/1986 | Knickerbocker et al. . | |
| 4,700,997 | 10/1987 | Strand | 439/372 |
| 4,718,867 | 1/1988 | Seidel et al. | 439/609 |
| 4,759,723 | 7/1988 | Siemon . | |
| 4,822,297 | 4/1989 | Prince et al. | 439/731 X |
| 4,824,383 | 4/1989 | Lemke | 439/608 X |
| 4,834,669 | 5/1989 | Siemon et al. . | |
| 4,878,848 | 11/1989 | Ingalsbe . | |
| 4,909,753 | 3/1990 | Siemon et al. . | |
| 4,925,393 | 5/1990 | Ingalsbe . | |
| 4,964,812 | 10/1990 | Siemon et al. . | |
| 4,968,260 | 11/1990 | Ingalsbe . | |
| 5,114,363 | 5/1992 | Mitra | 439/491 |
| 5,118,310 | 6/1992 | Stroede et al. | 439/405 X |
| 5,160,273 | 11/1992 | Carney . | |
| 5,328,380 | 7/1994 | Carney | 439/608 X |
| 5,393,235 | 2/1995 | Ingalsbe | 439/709 X |
| 5,460,545 | 10/1995 | Siemon et al. | 439/608 |

OTHER PUBLICATIONS

AT&T Systimax Premises Distribution System, Closures, Cross-Connects & Interconnects, BICSI Newsletter, Dec. 1992.

*Primary Examiner*—Khiem Nguyen

*Attorney, Agent, or Firm*—Fishman, Dionne, Cantor & Colburn

[57] ABSTRACT

The field terminable patch connector comprises three separable upper and lower body or housing portions, all three of which have mutual interlocking detent structures which permit the three housing portions to be assembled and locked together into a rigid assembly. One of the three housing portions is a contact insulator which has a multiplicity of slots and protrusions capable of retaining contacts for receiving conductors of a twisted pair cable. A metal shield is provided which fits between both the upper housing portion and contact insulator portion to shield pairs of conductors from one another. When properly field terminated with a Category 5 compliant cable, the patch connector of the present invention meets or exceeds the TIA/EIA TSB-40 Category 5 transmission requirements when mated with 110 type connector blocks. Other features include the ease of field assembly without special tools or operations (e.g. soldering or crimp tools), polarization structure which assures proper orientation of the mating conductors, a snap detent structure that provides a positive and stable mechanical connection to the connecting block, and an insulation displacement terminal which utilizes closed gap construction and low surface area mating contacts that minimize capacitive coupling between adjacent contact positions to assure Category 5 compliance. The shield not only provides crosstalk isolation between conductor pairs, but is also designed to allow access on either its outer surface or its inner surface, or both when mated with an appropriate shield connection means on the plug receptacle.

47 Claims, 22 Drawing Sheets

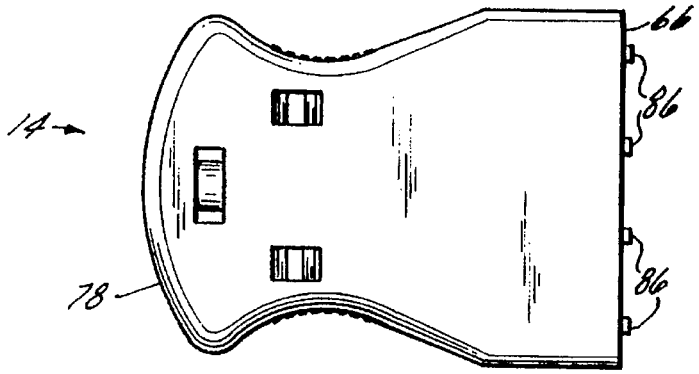
FIG. 15
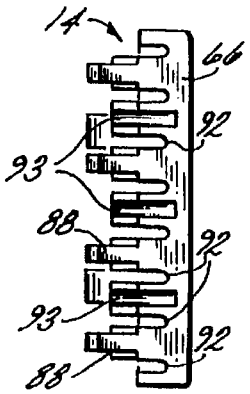
FIG. 12
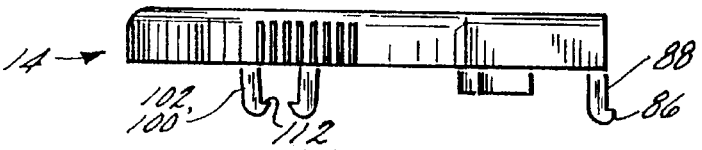
FIG. 14
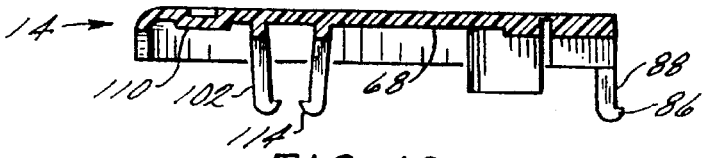
FIG. 16
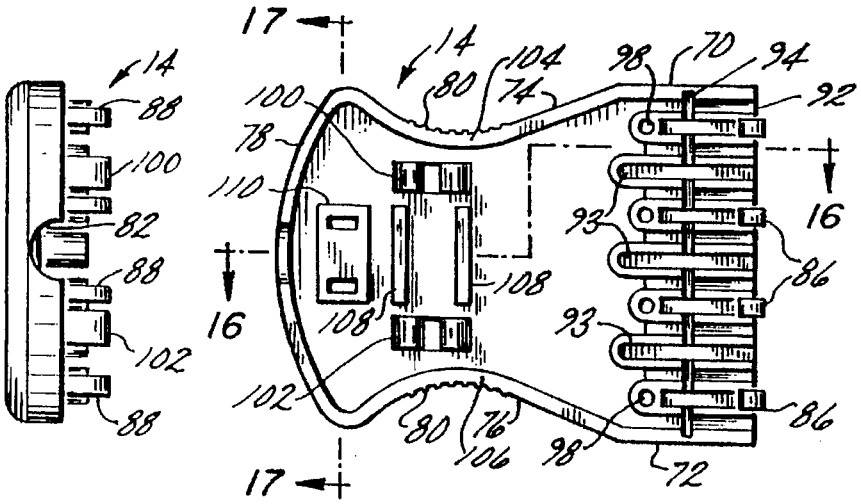
FIG. 13
FIG. 11
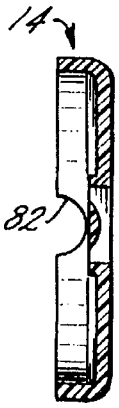
FIG. 17

PATCH CONNECTOR

CROSS REFERENCE OF RELATED APPLICATION

This is a continuation-in-part of U.S. application Ser. No. 08/144,768 filed Oct. 28, 1993 now U.S. Pat. No. 5,460,545.

BACKGROUND OF THE INVENTION

This invention relates to an electrical connector intended for use with terminal blocks commonly employed as a means of connection for wire networks. More specifically, this invention relates to an alternate means, namely a patch connector, for making electrical connection between wire and terminal points without the aid of tools or soldering.

In the communication industry, and more particularly in the telephone and data transmission industry, terminal blocks having a plurality of clip type electrical connectors or terminals protruding therefrom are commonly used. One such terminal block is the well known type 110 connecting block. Examples of 110 terminal blocks are described in U.S. Pat. Nos. 3,798,587 and 4,964,812, both of which are incorporated herein by reference. Having become widely accepted over the last ten years or so, the 110-type quick connect blocks have evolved into many shapes and sizes and have been the focal point of a variety of accessories and adapters.

Test adapters that plug onto the front of the terminal block such as disclosed in U.S. Pat. No. 4,878,848 may be used to connectorize the terminals with modular jacks or other industry standard connectors. The limitation of these devices is that they cannot always be field wired and they cannot always be mounted end to end or side to side without missing terminal locations that may require access. An example of another such test adapter for 66 type connector blocks is described in U.S. Pat. No. 4,585,290, which is assigned to the assignee hereof. Other examples of prior art test adapters are discussed in U.S. Pat. No. 4,585,290.

While the connection points on the terminal block may be capable of terminating wire directly via a solder joint or insulation displacement, well known patch connectors provide a means for making additional connections for temporary or long term use. Once wired, a patch connector is a multiple wire connector that may be installed and removed from the terminal block for the purpose of branching off existing lines or connecting together discrete areas of the terminal field.

Improved terminal block patching devices which allow for field wiring are disclosed in U.S. Pat. No. 4,759,723 and U.S. Pat. No. 4,834,669, both of which are assigned to the assignee hereof and incorporated herein by reference. While well suited for their intended purposes, these prior patch connectors are designed primarly for use in connection with terminal blocks incorporating type 66 terminals. However, there is a need for a low cost and reliable patch connector which can be field terminated and which can be used with other types of terminal blocks.

Other patch connectors are available that provide means for accomplishing connections between shielded twisted-pair cables. One such patch connector is disclosed in U.S. Pat. No. 5,160,273 ('273). It will be appreciated that the patch connector of the '273 patent relies on a printed circuit board to provide connections to both signal carriers and to shield conductors. One limitation of the '273 patent is that it requires an additional connection between the cable shield termination means and the printed circuitry. This added connection, plus the complex geometry of the circuit path, combined with the limited surface available for the shield path, due to the presence of signal traces on the printed circuit board, results in limited high frequency shield effectiveness. An additional limitation of the '273 patent is that it requires the use of a specialized receptacle in order to accomplish connections to both signal carriers and the shield, and, therefore is not compatible with the well known 110 type connector. Other prior art patch connectors exist that are intended to plug onto 110-style connecting blocks, but these connectors are encumbered by limitations of their own. In particular, they lack provisions for shield terminations. Also, their design, and means of cable preparation and termination make them difficult to use in the field and still provide Category 5 transmission performance as defined in TIA/EIA TSB40.

The "cross-over lead" technique used in prior art 110 patch products to achieve Category 5 performance requires that twisted pair conductors be terminated in a different sequence on the patch connector than on the 110 connecting block to which it connects. This limitation, combined with the physical difficulty with placing precut wires in their respective termination slots while maintaining pair twists as close as possible to the point of termination, as is necessary to achieve Category 5 performance, makes field termination impractical. Still other 110-type patch connectors are available that are capable of field terminations, but these connectors do not offer Category 5 transmission performance. Heretofore, no prior art 110-type patch connectors offer provisions for shield connection.

Therefore, it will be appreciated that there is a need for a patch connector which can mate with the 110-type connecting blocks and make optional connections to cable shielding and which can provide Category 5 transmission performance while preserving the capability for terminations by installers and technicians in the field.

SUMMARY OF THE INVENTION

The above discussed and other problems and deficiencies of the prior an are overcome or alleviated by the field terrainable patch connector of the present invention. In accordance with the present invention, the patch connector comprises three separable upper and lower body or housing portions, all three of which have mutually interlocking detent structures which permit the three housing portions to be assembled and locked together into a rigid assembly. One of the three housing portions is the contact insulator which in the case of the four pair connectors, has a multiplicity of slots and protrusions capable of retaining eight contacts for receiving eight conductors of a four twisted pair cable. In addition, a metal shield is provided which fits between both the upper housing portion and contact insulator portion. This metal shield portion shields (e.g., electrically isolates) the four pairs of conductors from one another and is held in position by the same aforementioned interlocking detents. Other embodiments include one, two and three pair connections. The two and three pair connection also contain a metal shield and a multiplicity of slots and protrusions for directing the relevant number of conductors. The one pair connector, however, does not contain a metal shield.

There are two sets of double detents toward the back of the upper housing portion or cover that snap or mate into two sets of double detent receiver slots that are positioned toward the rear of the lower housing in an aligned position with the two sets of double detents in the upper housing. When properly field terminated and used with a Category 5 compliant cable, the patch connector of the present invention meets or exceeds the TIA/EIA TSB-40 Category 5 transmission requirements when mated with 110 type connector blocks.

The two, three and four pair patch connectors of the present invention utilize a novel shield construction that not only provides crosstalk isolation between conductor pairs, but is also designed to allow access on either its outer surface or its inner surface, or both when mated with an appropriate shield connection means on the plug receptacle. The novel structure provides shield connections between cables with inherently low transfer impedance and therefore assures high-frequency shield effectiveness.

Another important feature of the present invention is the ability to pull wire pairs into their respective positions in the patch cover. Once the cable jacket is secured in the cover, wire pairs may be pulled into their respective location. The latch detent features in the cover act to separate the tip and ring conductors and urge them outward and into their respective IDC termination slots. Once all pairs are positioned, the excess length of insulated wires are accessible on all sides, such that they may be trimmed prior to termination.

The present invention also provides shield means in the two, three and four pair connectors for 110-type termination blocks to assure that shield integrity is maintained between cables and that shield elements are connected before signal conductors of the plug and socket connectors are allowed to touch and are disconnected after plug and socket signal connections are broken.

In general, the present invention provides the following benefits over the prior art: (1) shielding between pairs (two, three and four pair connectors) for improved crosstalk performance regardless of whether or not a cable shield is present; (2) low inductance, low transfer impedance shield access on the inner or outer shield surfaces, or both; (3) make first break last shield connection; (4) low surface area signal contacts for reduced crosstalk between pairs; (5) pull through access for ease of cable preparation and trimming; and (6) cover and base housings may be selectively coated with conductive material to further enhance shield effectiveness with respect to electromagnetic emissions at very high frequencies.

Other features of this invention include color coding capability when used with colored icons, the ease of field assembly without special tools or operations (e.g. soldering or crimp tools), polarization means which assures proper orientation of the mating conductors, a snap detent means that provides a positive and stable mechanical connection to the connecting block, and an improved insulation displacement terminal which preferably utilizes a small preferably about 0.010 gap construction and low surface area mating contacts that minimize capacitive coupling between adjacent positions to assure Category 5 compliance.

The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES:

FIG. 11 is an inside plan view of the cover housing of the device of FIG. 1;

FIG. 12 is a front elevation view of the cover housing of FIG. 11;

FIG. 13 is a rear elevation view of the cover housing of FIG. 11;

FIG. 14 is a side elevation view of the cover housing of FIG. 11;

FIG. 15 is an outside plan view of the cover housing of FIG. 11;

FIG. 16 is a cross sectional elevation view along the line 16—16 of FIG. 11;

FIG. 17 is a cross sectional elevation view along line 17—17 of FIG. 11;

Figure 99:
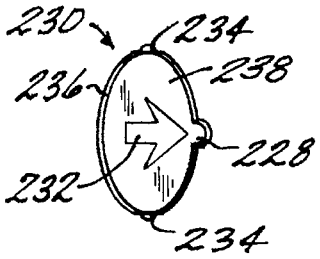
Figure 100:
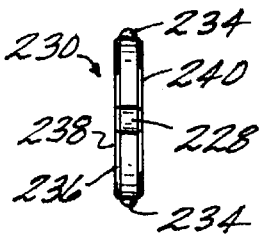
Figure 101:
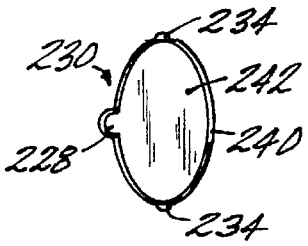
Figure 102:
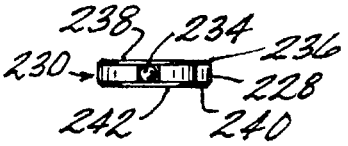
Figure 41:
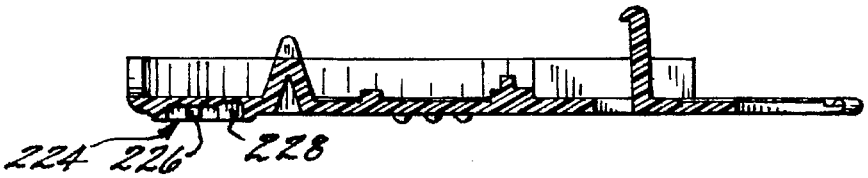
FIG. 41 is a cross section of FIG. 40 taken along section line 41—41.
Figure 42:
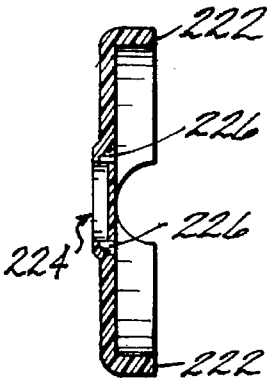
FIG. 42 is a cross section of FIG. 40 taken along section line 42—42.
Figure 40:
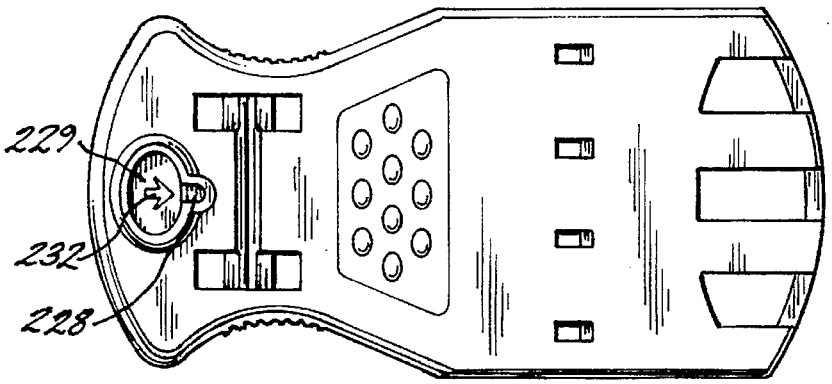
FIG. 40 is a plan view of the base of the alternate embodiment.
Figure 44:
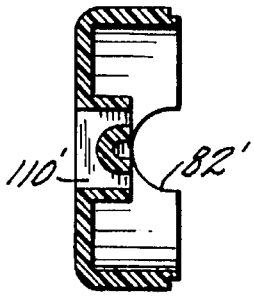
FIG. 44 is a cross section of FIG. 43 taken along section line 44—44.
Figure 72:
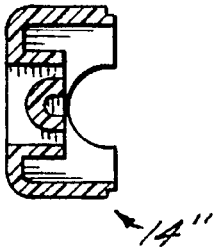
Figure 71:
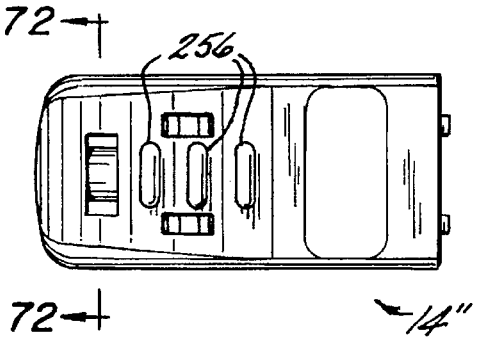
Figure 73:
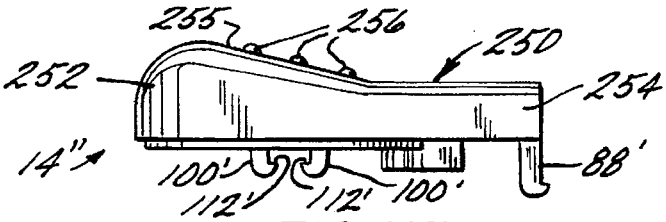
Figure 76:
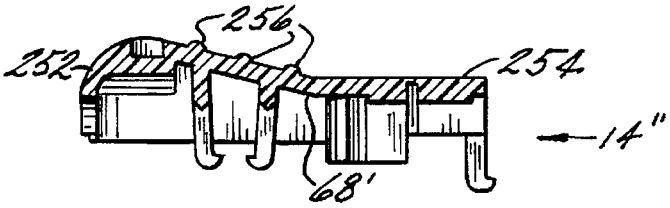
Figure 75:
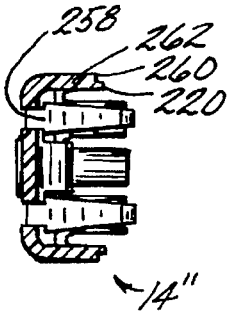
Figure 74:
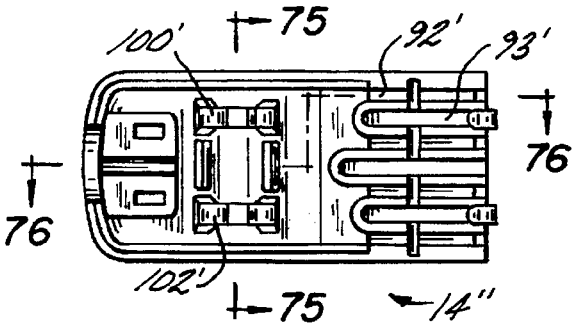
Figure 77:
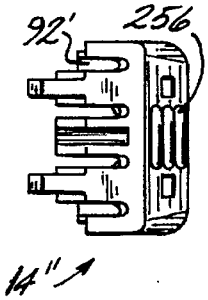
Figure 80:
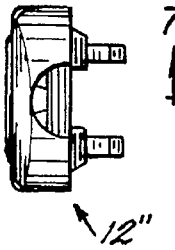
Figure 78:
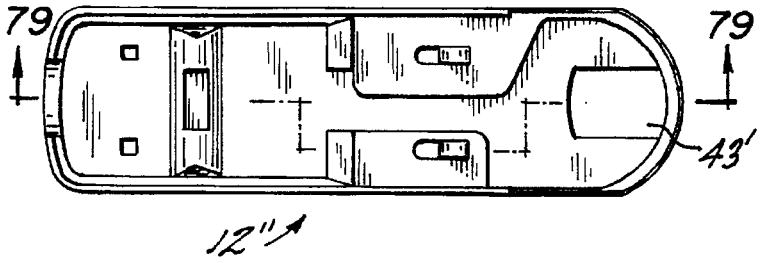
Figure 81:
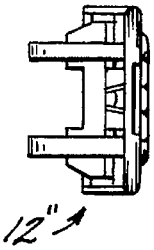
Figure 79:
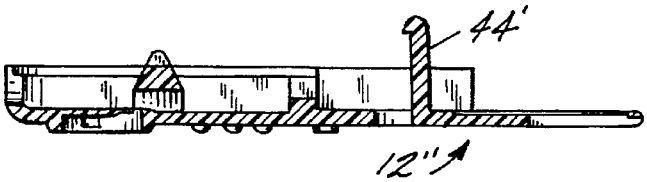
Figure 82:
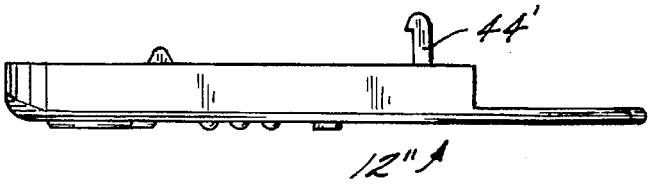
Figure 85:
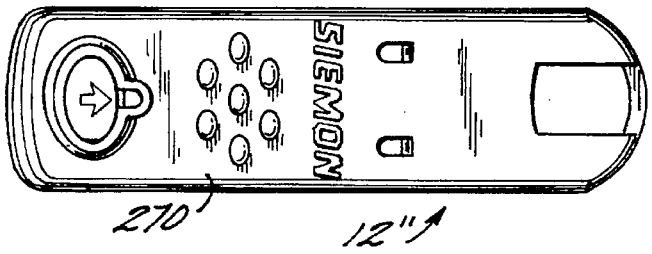
Figure 87:
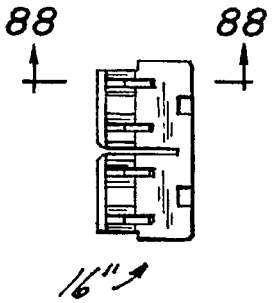
Figure 84:
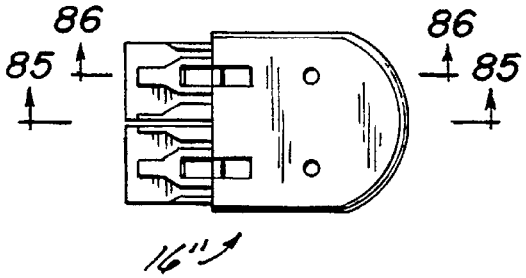
Figure 89:
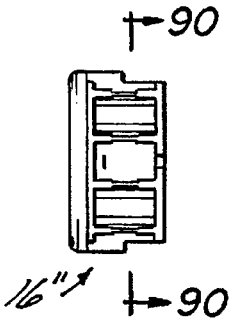
Figure 86:
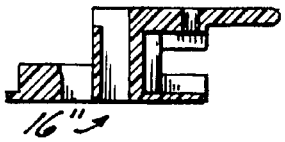
Figure 90:
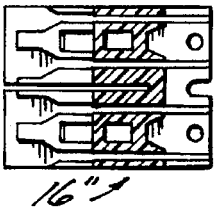
Figure 92:
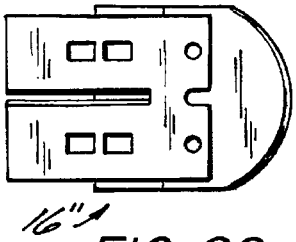
Figure 85:
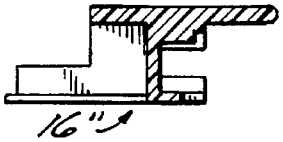
Figure 88:
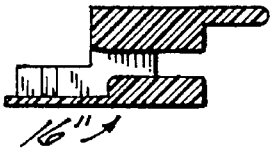
Figure 91:
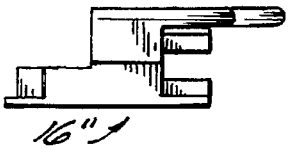
Figure 93:
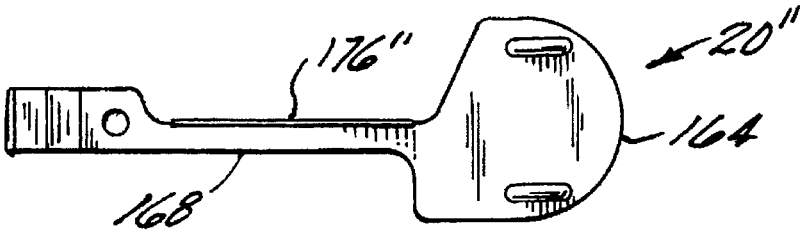
Figure 94:
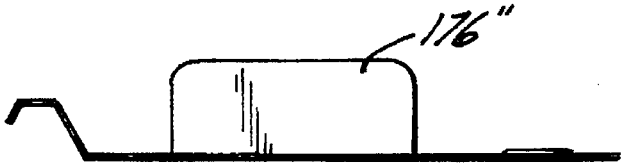
Figure 96:
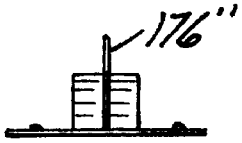
Figure 95:
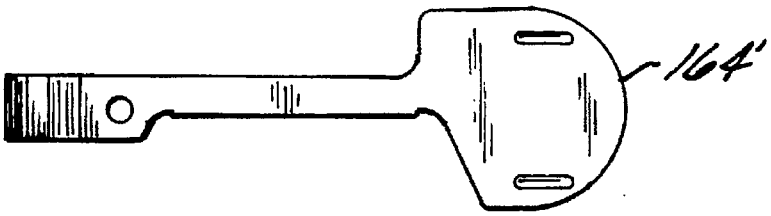
Figure 98:
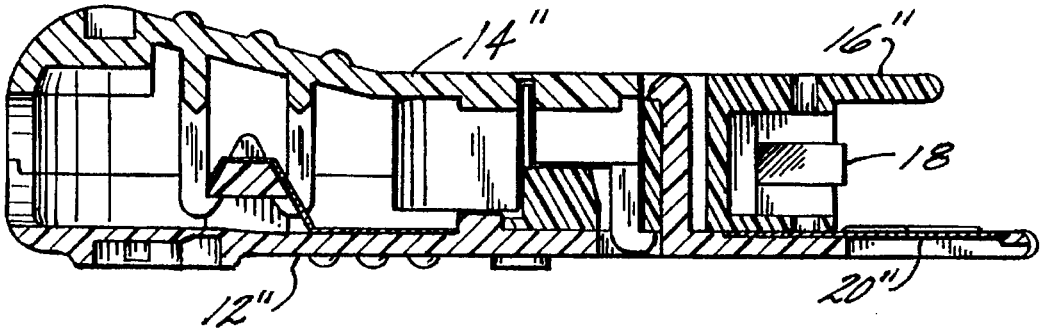
Figure 97:
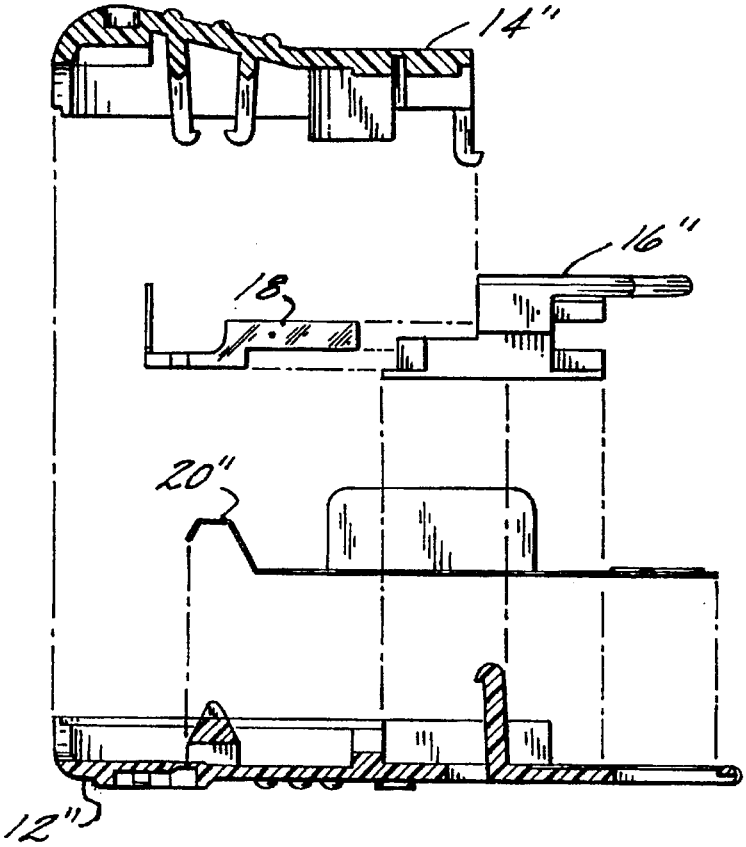
Figure 103:
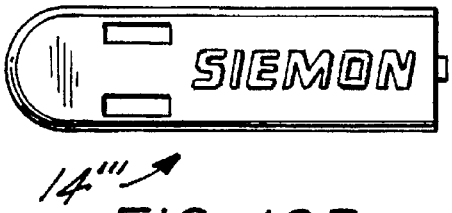
Figure 104:
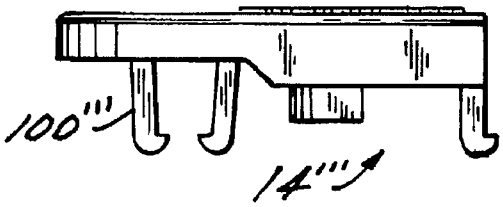
Figure 105:
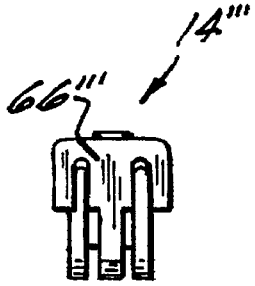
Figure 107:
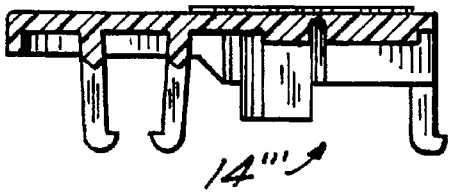
Figure 106:
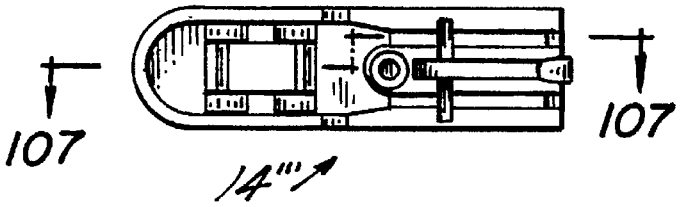
Figure 111:
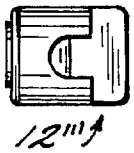
Figure 108:
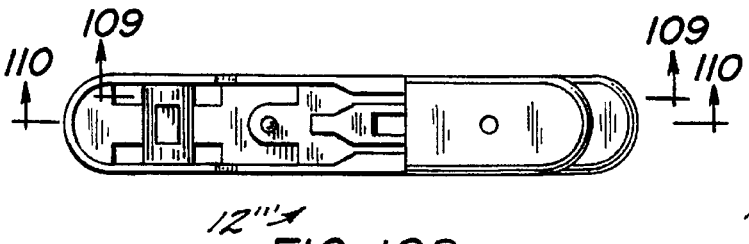
Figure 112:
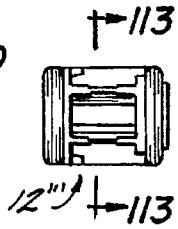
Figure 109:
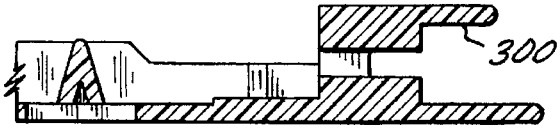
Figure 110:
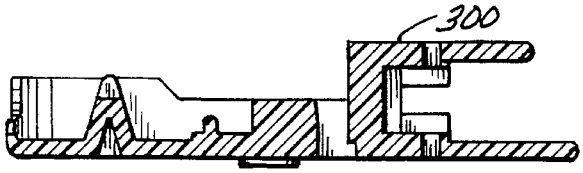
Figure 113:
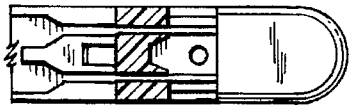
Figure 115:
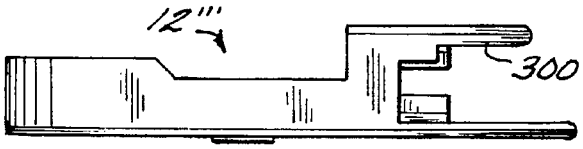
Figure 114:
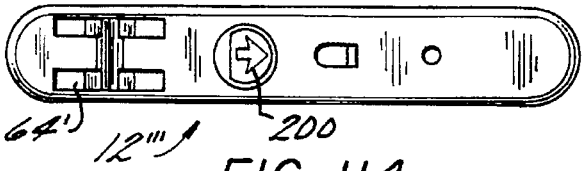
Figure 117:
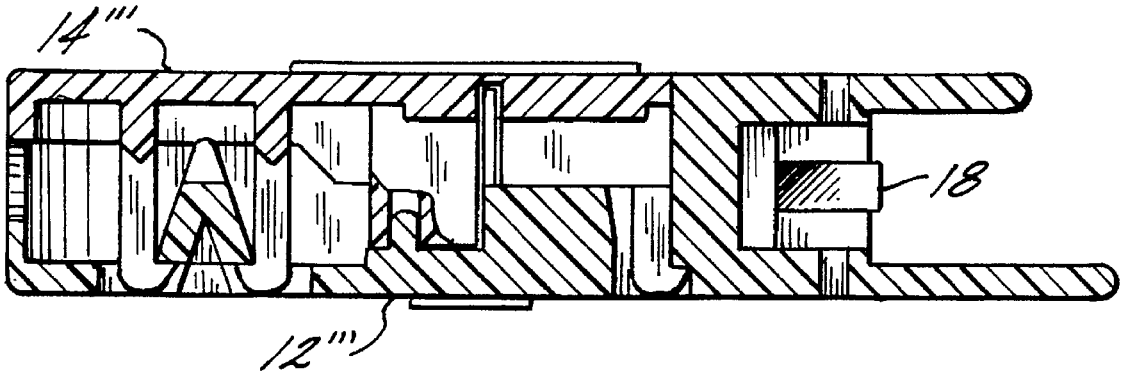
Figure 116:
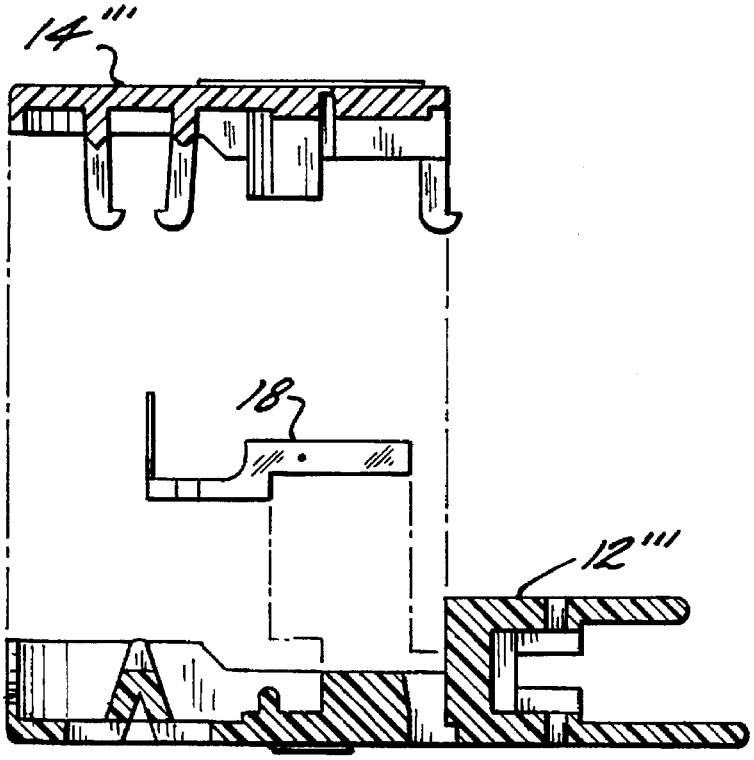

FIG. **70*a*** is an exploded view of the three pair connector;

FIG. 71 is a plan view of the cover of the two pair embodiment;

FIG. 72 is a cross section of FIG. 71 taken along section line 72—72;

FIG. 73 is a side elevation view of the cover of the two pair embodiment;

FIG. 74 is an underside plan view of the cover of the two pair embodiment;

FIG. 75 is a cross section of FIG. 74 taken along section line 75—75;

FIG. 76 is a cross section of FIG. 75 taken along section line 76—76;

FIG. 77 is a front end view of FIG. 74;

FIG. 78 is an interior plan view of the base of the two pair embodiment;

FIG. 79 is a cross section of FIG. 78 taken along section line 79—79;

FIG. 80 is an end view illustrating the rear of the base of the two pair embodiment;

FIG. 81 is an end view illustrating the front of the base of the two pair embodiment;

FIG. 82 is a side elevation view of the base of the two pair embodiment;

FIG. 83 is a bottom plan view of the base of the two pair embodiment;

FIG. 84 is a top plan view of the two pair insulator;

FIG. 85 is a cross section of FIG. 84 taken along section line 85—85;

FIG. 86 is a cross section of FIG. 84 taken along section line 86—86;

FIG. 87 is a rear end view of the two pair insulator;

FIG. 88 is a cross section of FIG. 87 taken along section line 88—88;

FIG. 89 is a front end view of the two pair insulator;

FIG. 90 is a cross section of FIG. 89 taken along section line 90—90;

FIG. 91 is a side elevation view of the two pair insulator;

FIG. 92 is a bottom plan view of the two pair insulator;

FIG. 93 is a top plan view of the two pair shield;

FIG. 94 is a side elevation view of the two pair shield;

FIG. 95 is a bottom plan view of the two pair shield;

FIG. 96 is a front end view of the two pair shield;

FIG. 97 is an exploded view of the two pair connector;

FIG. 98 is a cross section of the assembled two pair connector taken along the section line (illustrated in the base view) 79—79 of FIG. 78;

FIG. 99 is a plan view of an oval icon of the invention;

FIG. 100 is an end view of an oval icon of the invention;

FIG. 101 is a rear plan view of an oval icon of the invention;

FIG. 102 is a side view of an oval ion of the invention;

FIG. 103 is a top plan view of the one pair cover of the invention;

FIG. 104 is a side elevation view of the one pair cover of the invention;

FIG. 105 is a from end view of the one pair cover of the invention;

FIG. 106 is an underside plan view of the one pair cover of the invention;

FIG. 107 is a cross section of FIG. 106 taken along section line 107—107;

FIG. 108 is an interior plan view of the one pair base insulator which is one piece in the one pair construction;

FIG. 109 is a cross section of FIG. 108 taken along section line 109—109;

FIG. 110 is a cross section of FIG. 108 taken along section line 110—110;

FIG. 111 is a rear end view of the one pair base insulator;

FIG. 112 is a front end view of the one pair base insulator of the invention;

FIG. 113 is a cross section of FIG. 112 taken along section line 113—113;

FIG. 114 is a bottom plan view of the one pair base/insulator of the invention;

FIG. 115 is a side elevation view of the one pair base/insulator of the invention;

FIG. 116 is an exploded view of the one pair connector;

FIG. 117 is a cross section view of FIG. 108 taken along section line 109—109 and presuming the section line extended through the entirely assembled one pair connector.

DESCRIPTION OF THE PREFERRED EMBODIMENT

It is important to note throughout this application that the embodiments of the invention are described relative to a base and cover which in actual use are upside down, i.e., the cover is on the bottom and the housing base is on the top. The invention is described in the inverted manner since it is conceptually easier to consider the elements in the order in which they are assembled.

Referring first to FIGS. 1–4, a fully assembled four pair patch connector in accordance with the present invention is shown generally at 10. As shown in FIGS. 1—4, patch connector 10 is comprised of a preferably insulative plastic housing comprised of three separable parts, a lower first housing (main body) or base section 12, an upper second housing or upper housing cover 14 and a contact insulator housing 16. Lower housing or base 12 is shown in detail in FIGS. 5–10, upper housing or cover 14 is shown in detail in FIGS. 11–17 and insulator housing 16 is shown in detail in FIGS. 18—26. Patch connector 10 also includes a plurality of connector contacts 18 shown in detail in FIGS. 27–29. In addition, there is a metal shield 20 shown in detail in FIGS. 30–33.

Turning now to a discussion of the lower base housing 12, housing 12 is comprised of a non-conductive body which in the plan view is generally rectangular in shape. Front end surface 22 (best seen in FIG. 8) has a smooth full radius that blends into inside surface 31 and bottom outside surface 32. Straight sides 24, 26 blend into arcuate gripping segments 34, 36 which in turn blend radially into arcuate rear surface 38. Arcuate gripping segments 34, 36 each have a multiplicity of protrusions 40 for gripping purposes. Arcuate rear surface 38 has an oblong (not shown) or a semi-circular cutout 84 sized to receive the outer jacket of a cable (not shown).

Extending upwardly from inside planar surface 30, is a stepped planar surface 31. Planar surface 31 is parallel to surface 30. These two surfaces are stepped apart a distance that is approximately equal to the thickness of metal shield 20. The inside edge of stepped surface 31 defines a cavity with planar surface 30, used to position and retain metal shield 20. Extending rearwardly from arcuate front end 22 and along planar inside surface 31 are a multiplicity of web sections 42 (preferably three). Web sections 42 define the front end surface of a multiplicity of openings 43 (preferably three), through which metallic shield 20 may be accessed from the direction of outside surface 32 for the purpose of making electrical connections with a plug receptacle (not shown). The outside surface of webbed sections 42 is stepped inwardly from outer surface 32 and is approximately aligned with inside surface 30, so as to allow connections to be made to outer surface 65 of metallic shield 20 with minimum mechanical interference and without excessive deformation of mating contacts. At a distance of about one third of the overall length of base housing 12 from front surface 22 there are four detents 44 that extend upwardly and flexibly from inside planar surface 31. The ends of each detent 44 include a radius 46 which leads to an angled insertion surface 50 and finally terminates at a lip 48. Insertion surface 50 is at preferably a 60° angle relative to inside surface 31. The underside lip 48 preferably dips downwardly 2° toward inside surface 31 as it extends from the base of detent 44 to surface 50. Adjacent to the four detents 44 are four rectangular detent openings 54. The four detents 44 are designed to secure insulator housing 16 to base section 12 as will be discussed hereinafter.

About midway of the overall length of base housing 12, there are four spaced pads 56 that extend upwardly a short distance from inside surface 31. Located and extending upwardly from each of the four pads 56 are dowels 58. Dowels 58 are for purposes of locating and mating upper housing or cover 14 to match up properly with lower base housing 12. Located at about two thirds of the distance from the front end 22 of the overall length of base housing 12 is a locator dowel 60 for purposes of locating and retaining the metal shield 20.

Between arcuate rear surface 38 and shield locator dowel 60, there is a "V" shaped protrusion 62 that both supports shield 20 in position and also acts as a means of shield termination when a cable shield is present, as a secondary strain relief for the patch cable, and as a stiffening rib to support the two sets of double detents that extend from upper housing cover 14. "V" shaped protrusion 62 extends upwardly from inside surfaces 31 and 30. Adjacent to each end of "V" shaped protrusion 62 are two sets of detent slots 64 (two for each set) to receive the two sets of double detents from upper housing cover 14 in snap-lock position.

Arcuate rear surface wall 38, arcuate gripping segments side walls 34, 36 and a sufficient length of each of straight side walls 24, 26 extend upwardly from inside surfaces 30 and 31 the same distance as the mating side walls of upper housing cover 14 (to be discussed hereinafter). The height of straight side walls 24, 26 abruptly decrease at vertical edges 63, 65, respectively to match the plane of inside surface 31. The length of the walls just described are equal to the total length of the walls of upper housing cover 14 combined with the side walls of the insulator housing 16 (also to be discussed hereinafter).

Turning now to FIGS. 11–17, the details of upper housing 14 can be seen. Staffing from planar front edge 66, and extending upwardly from inside surface or plane 68, two short spaced-apart side walls 70, 72 blend smoothly into arcuate gripping segments 74, 76, each including a reverse curve which finally blends into rear arcuate segment 78. Arcuate gripping segments 74, 76 have a multiplicity of protrusions 80, such that when upper housing 14 is assembled to housing base 12, the protrusions 80 will match up with the protrusions 40. Rear arcuate segment 78 has an oblong, (not shown) or a semi-circular cutout 82 sized to receive the outer jacket of a cable (see FIGS. 34–36). When upper housing 14 is assembled to housing base 12, semi-circular cutouts 82 and 84 form a smooth full opening to allow the passage of the cable to the interior of housing base 12 and upper housing 14. It should be noted that when housing cover 14 is assembled to base housing 12, the side walls 70, 72, 74, 76 and 78 of housing cover 14 match up smoothly with side walls 24, 26, 34, 36 and 38 of base housing 12, respectively.

Front edge and face 66 of upper housing 14 is a straight planar surface except for the slight protrusion of four detent lips 86. Lips 86 are integral with detents 88 which extend upwardly from front edge and face 66. Detents 88 pass through rectangular holes 90 (shown in FIG. 24) of insulator housing 16 (details of insulator housing 16 to be discussed hereinafter) so as to lock together when the sub-assembly (e.g., base housing 12, housing cover 14, and insulator housing 16 along with a plurality of connector contacts 18 and metal shield 20) is complete.

Extending rearwardly from front edge and face 66 are a plurality of grooves 92 (preferably eight) sized to accept standard single conductor telecommunications wire complete with insulation (conductors shown in FIG. 34) preferably stranded size AWG 26–24. Grooves 92 preferably have a semi-circular base. About a ¼" distance back from front edge and face 66 there are a plurality of transverse slots 94 sized to receive the self terminating ends 96 of contacts 18 (contacts 18 are described in more detail hereinafter). Beyond transverse slots 94, grooves 92 continue rearwardly from front edge and face 66 to just beyond a series of locating holes 98. Locating holes 98 receive dowels 58 when the upper housing 14 is assembled to base housing 12.

Extending rearwardly from front face 66, and positioned between even numbers of transverse slots 92, are pair separation slots 93. It will be appreciated that pair separation slots 93 are positioned and sized in such a way as to align and receive tabs 176, 178 and 180, of metallic shield 20 (to be discussed hereinafter). It will be appreciated that the length of pair separation slots 93, is greater than the length of grooves 92, to assure pair separation to the greatest extent possible so as to optimize crosstalk performance. The housing wall that encloses slot 93 physically extends out to provide a physical barrier between pairs. This barrier physically keeps untwisted tip and ring conductors away from adjacent pairs and assures that the parallel portions of adjacent pairs are separated by a shield.

In line with the gripping segments 74, 76 near the inside arcuate surfaces 104, 106 are two sets of detents 100, 102 which extend upwardly from inside surface 68. Detent sets 100, 102 are inserted into the two sets of detent slots 64 of base housing 12 when cover housing 14 is assembled to base housing 12. Located between detent sets 100, 102 are two spaced rectangular cable supports 108 that extend a short distance upwardly from inside surface 68. Just in front and inside of rear arcuate segment wall 78 is a cable tie holding structure 110 for receiving a cable tie (see FIG. 34). Each detent set 100, 102 comprises two detents in spaced, opposing relation which extend upwardly from inside surface 68 preferably at an angle of 3° toward each other. The lip 112 preferably dips 6° from the horizontal. The angular face 114 is preferably at a 57° angle from the horizontal and rounding the outside edges of the detents with small radii is preferred. The four detents 88 preferably have a penetrating face angle of 30° from the vertical.

Turning now to FIGS. 18–26, a discussion of the contact insulator 16 follows. Looking at the plan view (FIG. 18), the forward edge 116 is a smooth radius arcuate or curve that blends into straight side edges 118, 120. Rearward from curved edge 116 on planar outside surface 117 are four through holes 122. In line with each of the four through holes 122 are eight spaced rectangular through holes 90 and 124. Through holes 90 and 124 are separated by a wall 128. Through holes 90 allow the passage of the four detents 44 of base housing 12 to latch onto lip edges 126 of wall 128 of contact insulator 16 (see FIG. 4).

Adjacent to wall 128 are the four rectangular through holes 124 which allow the passage of the four detents 88 of housing cover 14 to snappingly engage inside surface 125 of contact insulator 16. Upper portions of detents 88, are aligned with rectangular spacings 54 of housing 12 and are sized so as not to protrude beyond surface 32 of housing 12 when fully assembled. It will be appreciated that detents 44 of housing 12, and detents 88 of housing 14 are both designed to latch onto contact insulator 16, which, in turn, is intended to mate with contacts and housing means of a 110-style connector (not shown). This direct method of attachment of dependent housings 12 and 14 to contact housing 16 provides for the fabrication of a rigid sub-assembly that consists of contacts 18, metallic shield 20 and housing portions 12 and 16. This sub-assembly and cover 14 may be assembled in the factory or field, once the patch cable has been prepared for termination (see FIGS. 34–45). Because cover 14 latches to both the base housing 12, by means of detent sets 100, 102, and to contact housing 16, by means of detents 88, the design of the present invention results in a rigid finished connector assembly.

A multiplicity of spaced transverse through slots or channels 130 are provided in contact insulator 16 that are sized to receive the straight portion 132 of each contact 18 as will be discussed hereinafter. Each through slot 130 is associated with an inner chamfer 134 which is preferably 0.010 in length with an inclusive angle of preferably 53°. In addition, each through slot 130 is associated with an outer, larger chamfer 136 preferably with an inclusive angle of 60°, which in turn, leads to a larger straight channel 138. Thus, from the front toward the rear, through slot 130 includes inner chamfer section 134 leading to larger chamfer 136 and finally to straight channel 138. At the intersection between through slot 130 and housing body 115 is a stop wall 140 so that when the contact 18 is inserted, stop wall 140 will assure that the contact 18 is in its proper position and extends the proper amount through the contact mating face 142. Contact mating face 142 is configured for connection to the mating end of the 110-type block terminal and includes four V-shaped depressions 144 that are evenly spaced apart to blend with a flat area 146 at the bottom of the "V". At the top of the multiplicity of V-shaped channels 144, the mating surface 148 is planar. The entire shape and size of mating face 142 conforms with the standard mating shape required to mate with a 110 connector. The previously mentioned openings 122 on outer surface 117 and inner surface 125 are dimensioned and spaced to engage and mate with rounded protrusions normally associated with 110 terminal blocks.

Figure 28:
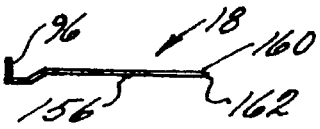
FIG. 28 is a plan view of the contact of FIG. 27.
Figure 29:
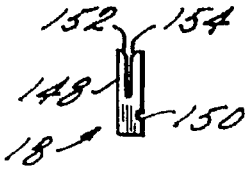
FIG. 29 is a rear elevation view of the contact of FIG. 27.
Figure 27:
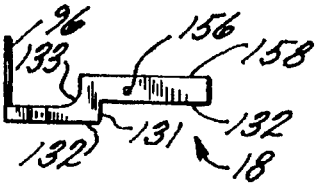
FIG. 27 is a side elevation view of the contact used in the device of FIG. 1.
Figure 5:
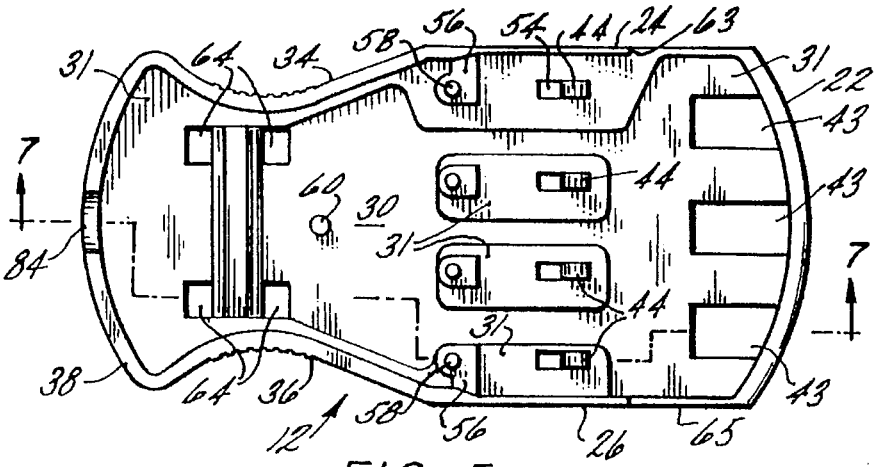
FIG. 5 is an inside plan view of the base housing of the device of FIG. 1.
Figure 6:
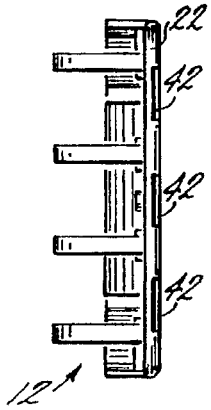
FIG. 6 is a front elevation view of the base housing of FIG. 5.
Figure 7:
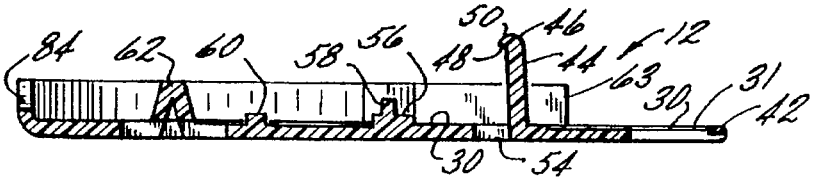
FIG. 7 is a cross-sectional elevation view along line 7—7 of FIG. 5.
Figure 8:
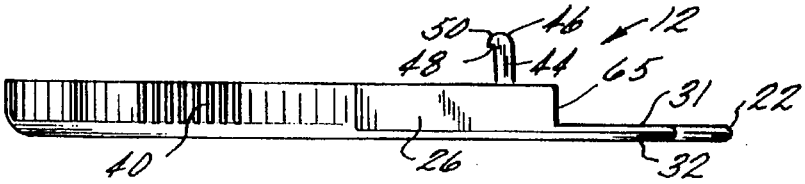
FIG. 8 is a side elevation view of the base housing of FIG. 5.
Figure 9:
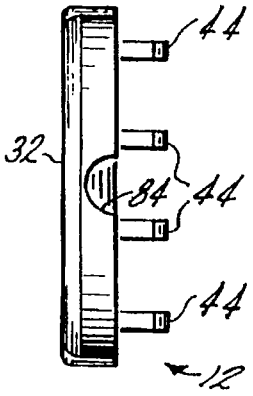
FIG. 9 is a rear elevation view of the base housing of FIG. 5.
Figure 10:
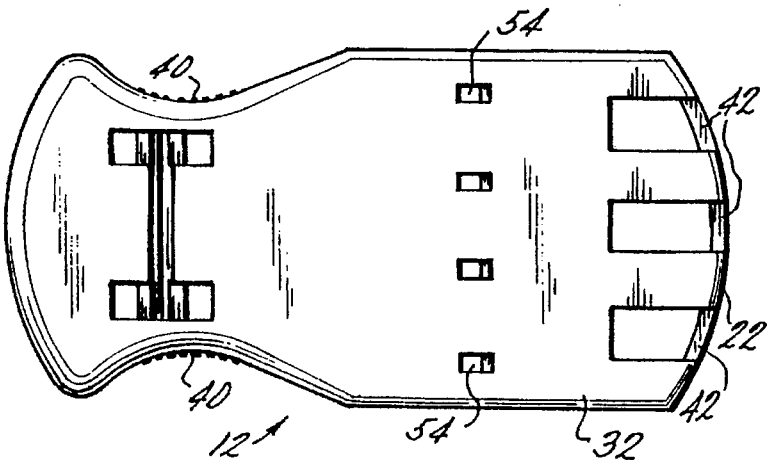
FIG. 10 is an outside plan view of the base housing of FIG. 5.
Figure 20:
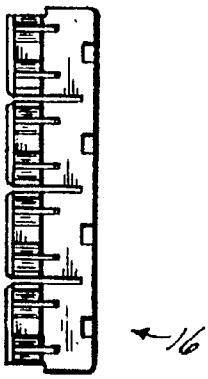
FIG. 20 is a rear elevation view of the contact insulator of FIG. 18.
Figure 18:
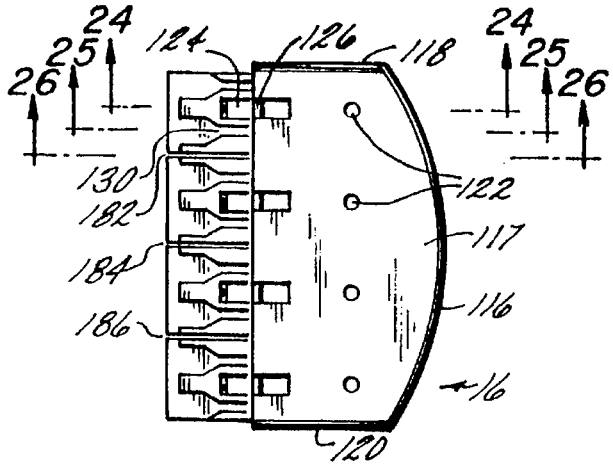
FIG. 18 is a top plan view of the contact insulator of the device of FIG. 1.
Figure 19:
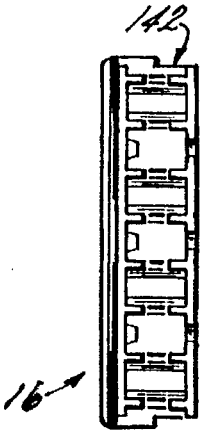
FIG. 19 is a front elevation view of the contact insulator of FIG. 18.
Figure 24:
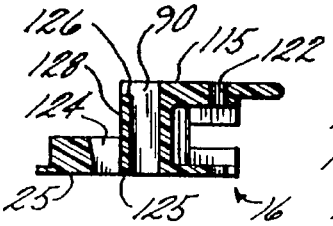
FIG. 24 is a cross sectional elevation view along the line 24—24 of FIG. 18.
Figure 25:
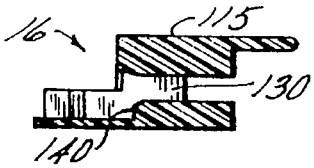
FIG. 25 is a cross sectional elevation view along the line 25—25 of FIG. 18.
Figure 23:
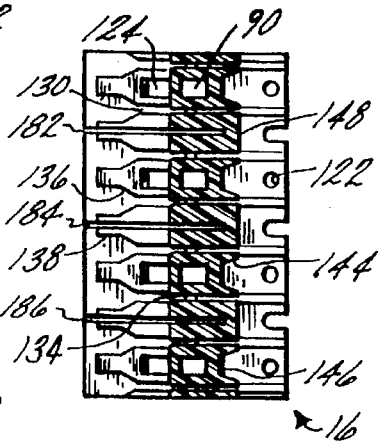
FIG. 23 is a cross sectional plan view along line 23—23 of FIG. 22.
Figure 21:
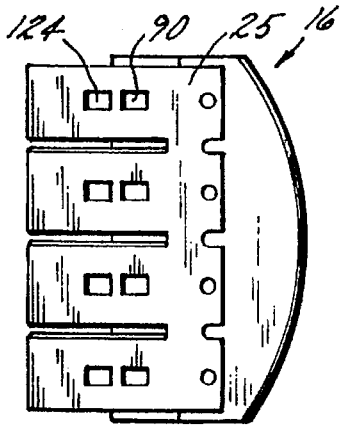
FIG. 21 is a bottom plan view of the contact insulator of FIG. 18.
Figure 26:
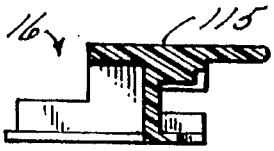
FIG. 26 is a cross sectional elevation view along the line 26—26 of FIG. 18.
Figure 22:
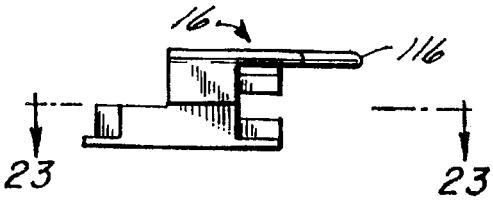
FIG. 22 is a side elevation view of the contact insulator of FIG. 18.
Figure 32:
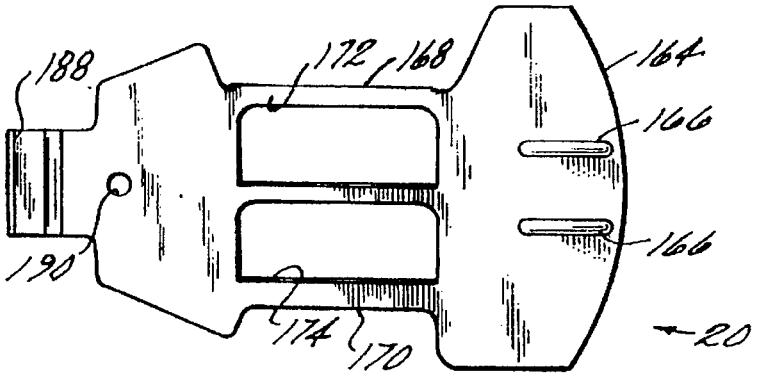
FIG. 32 is a top plan view of the shield of FIG. 30.
Figure 30:
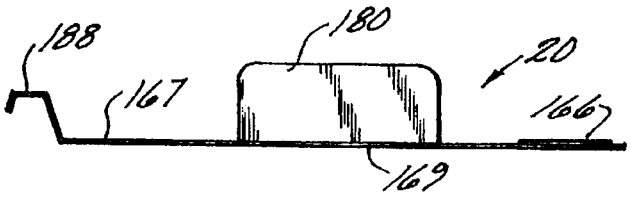
FIG. 30 is a side elevation view of the shield used in the device of FIG. 1.
Figure 31:
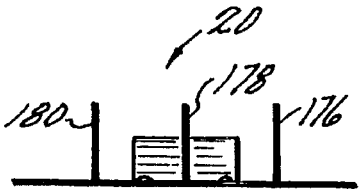
FIG. 31 is a front elevation view of the shield of FIG. 30.
Figure 33:
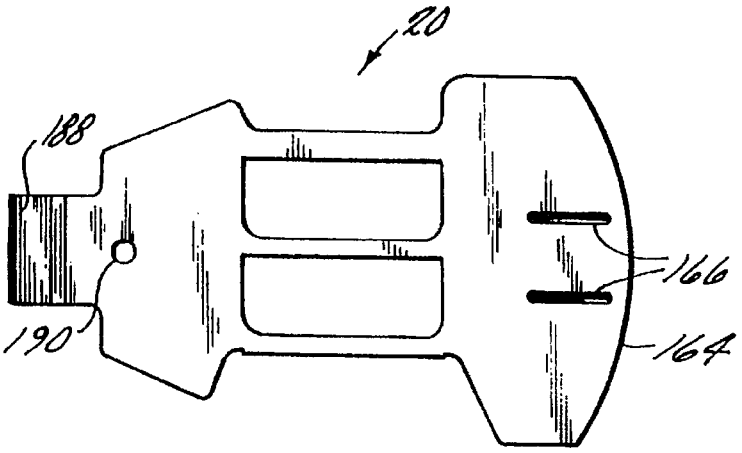
FIG. 33 is a bottom plan view of the shield of FIG. 30.

Turning now to FIGS. 27–29, each contact 18 is comprised of an insulation displacement self terminating spade (or fork) 148 and at approximately 90° thereto, a straight "zig-zag" portion 132 extends outwardly from fork 148. The insulation displacement slot preferably utilizes a closed gap construction that assures reliable connections to stranded wire cables. The blade portion 158 of contact 18 is of a reduced area in order to minimize capacitance between adjacent contact positions, so as to optimize crosstalk performance. This reduced area has the added benefit of minimizing material and plating costs for contact 18. The contact 18 is made of a conductive material, preferably phosphor bronze alloy C51000, "hard" temper and preferably nickel plated overall. Contact 18 has a bending relief cut 150. The thickness of contact 18 is preferably 0.017". The insulation displacement terminating slot 152 is preferably 0.010" or less in width and 0.140" in length. A guiding chamfer 154 on either side of terminating slot 152 is rounded. A detent dimple 156 is provided in the "zag" portion 158 of "zig-zag" portion 132. The tip 160 of contact 18 preferably has a chamfer 162 of 10° by 0.020" in length on both sides of the contact to assure ease of mating with the connector block (not shown). FIG. 27 shows two opposed and staggered stop surfaces 131 and 133 on "zag" portion 158 of contact 18. During assembly of contact 18, to insulator housing 16, stop surface 131 meets housing surface 140, so as to prevent over insertion of contact 18 into housing 16 during assembly and to prevent contact movement when the patch connector is removed from a 110-style block (not shown). For the completely assembled patch assembly, contact stop surface 133, is adjacent to front surface 66 of housing 14 to support contact 18 as it is mated with a 110-style connector (not shown).

Figure 1:
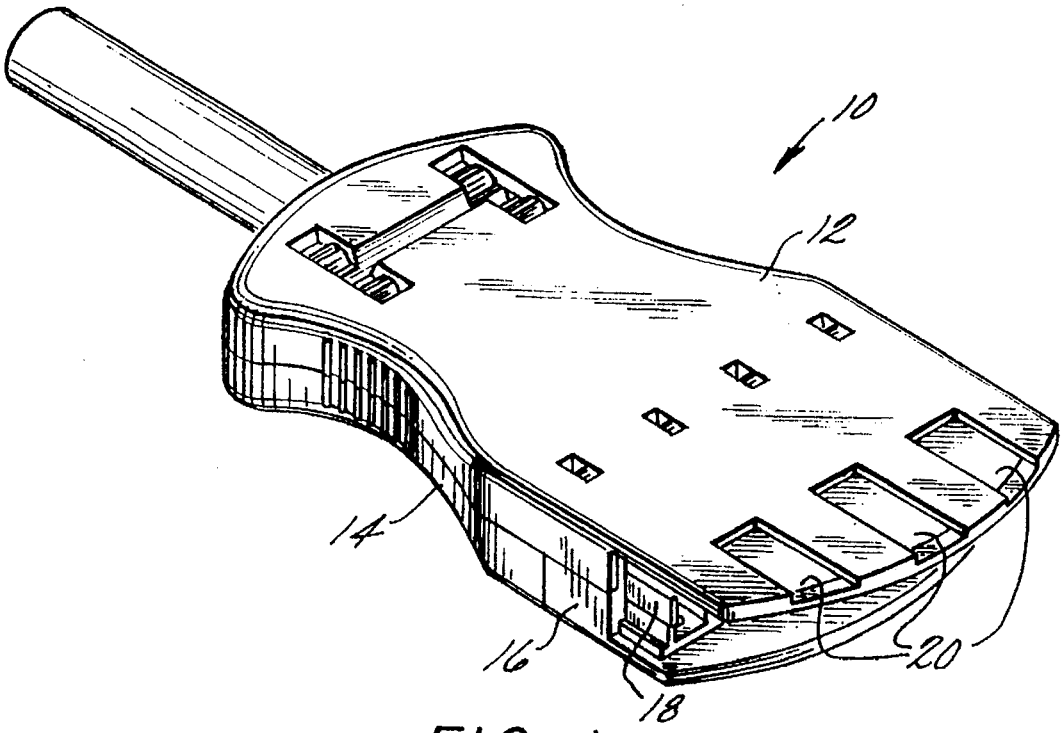
FIG. 1 is a perspective view of a wired and assembled patch connector in accordance with the present invention viewed from the contact direction.
Figure 2:
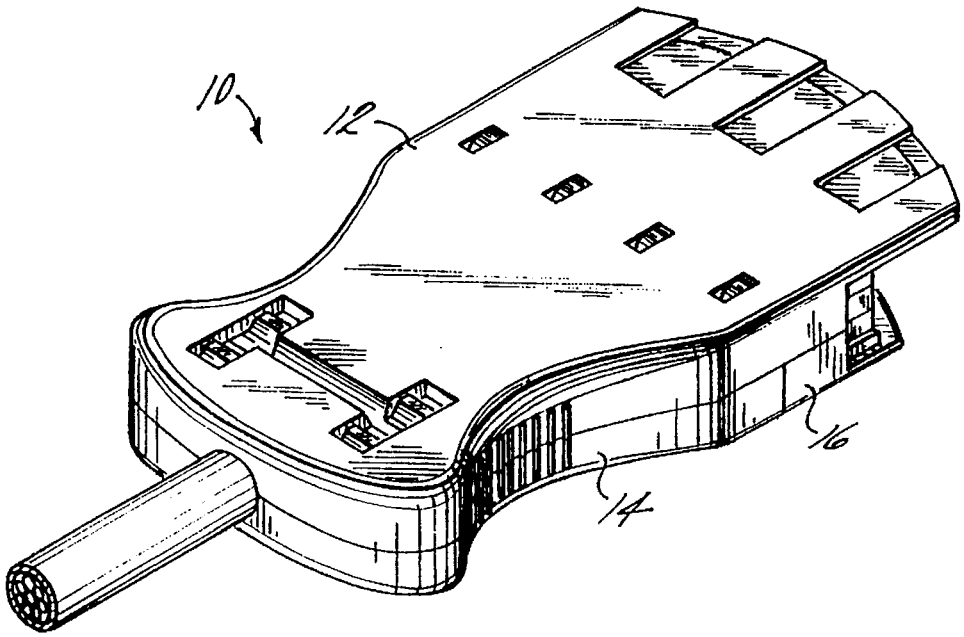
FIG. 2 is a perspective view of a wired and assembled patch connector in accordance with the present invention viewed from the gripper direction.
Figure 3:
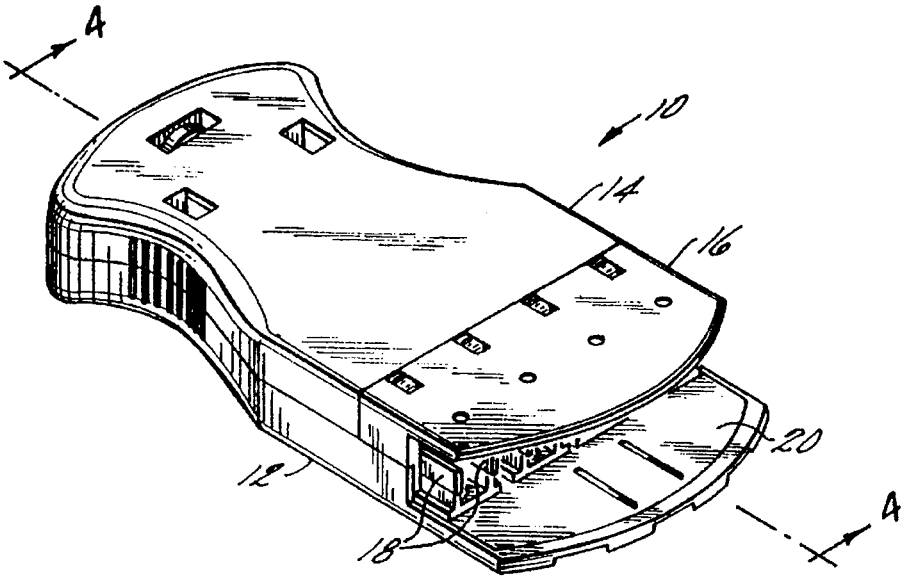
FIG. 3 is a perspective view of the device of FIG. 1 rotated 180° and shown without the cable assembled.
Figure 4:
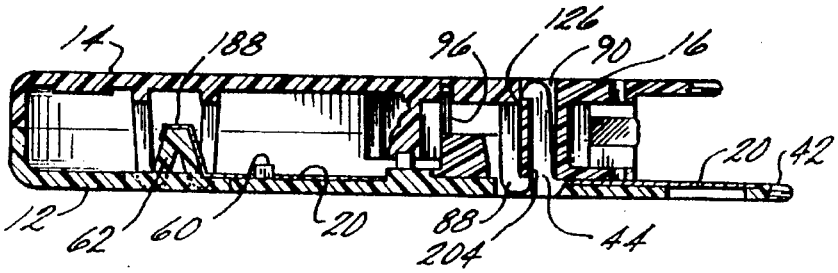
FIG. 4 is a cross sectional elevation view along the line 4—4 of FIG. 3.

Referring now to FIGS. 30–33, a metal shield 20 will now be described. Shield 20 is preferably one-piece and comprises a stamped metal part having an overall shape which conforms to the shape of inner surface 30 of main body or base section 12. A front end 164 of shield 20 has an arcuate shape commensurate with the arcuate shape 22 of main body 12. Extending rearwardly, from the front arcuate edge 164 are a pair of parallel spaced ribs 166 that protrude above inside surface 167 of metallic shield 20. Parallel ribs 166 are sized and positioned for the purpose of providing redundant positive connection means with a mated conductor, preferably one whose surface is curved and perpendicular to ribs 166, so as to result in optimum Herztian stress on the connection interface. These ribs also define the primary contact surface with the side of the 110 connector so as to prevent potential jamming of lead edge 164 on lower recessed edges of the 110-style connector. It will be appreciated that additional parallel ribs may be provided that protrude in the opposite direction (above outside surface 165), so as to align with openings 43 in housing base 12. These additional ribs (not shown) may also be used to optimize integrity of the shield connections that are made through openings 43 in housing base 12. The center portion of shield 20 includes two opposed cut outs 168, 170, defining a narrowed central section for shield 20. Within that narrowed section are a pair of spaced similarly shaped substantially rectangular openings 172, 174. Extending upwardly from the inward edge of cut-out 168 and from the corresponding edges of openings 172 and 174 are three spaced and parallel transverse shield tabs 176, 178 and 180, respectively. It will be appreciated that shield tabs 176, 178 and 180 are located in a position so as to be received in respective slots 182, 184 and 186 located in contact insulator housing 16 (see FIG. 23). As will be discussed hereinafter, shield tabs 176, 178 and 180 perform the important function of providing electrical isolation between adjacent pairs positioned within the contact insulator housing 16. Shield 20 terminates at a handle portion 188 which has a configuration commensurate with the V-shaped protrusion 62 in base 12. Between handle portion 188 and openings 172, 174, shield 20 has a converging cross-section with an aperture 190 centrally disposed therethrough. Aperture 190 is sized and configured to be received by locator dowel 60 when the shield is mounted on the inside surface 30 of base 12. This is best shown in FIG. 4 where the handle 188 is also shown being seated on V-shaped protrusion 62.

Figure 34:
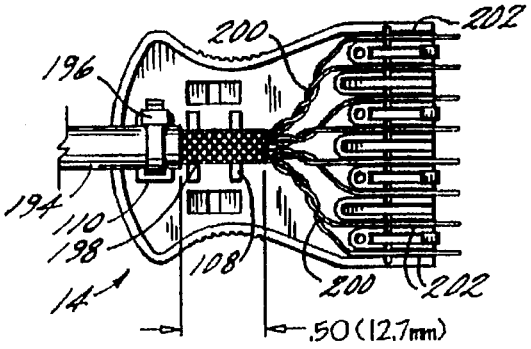
FIG. 34 is a plan view of the inside of the cover housing of FIG. 11 showing the lacing of field conductors.
Figure 35:
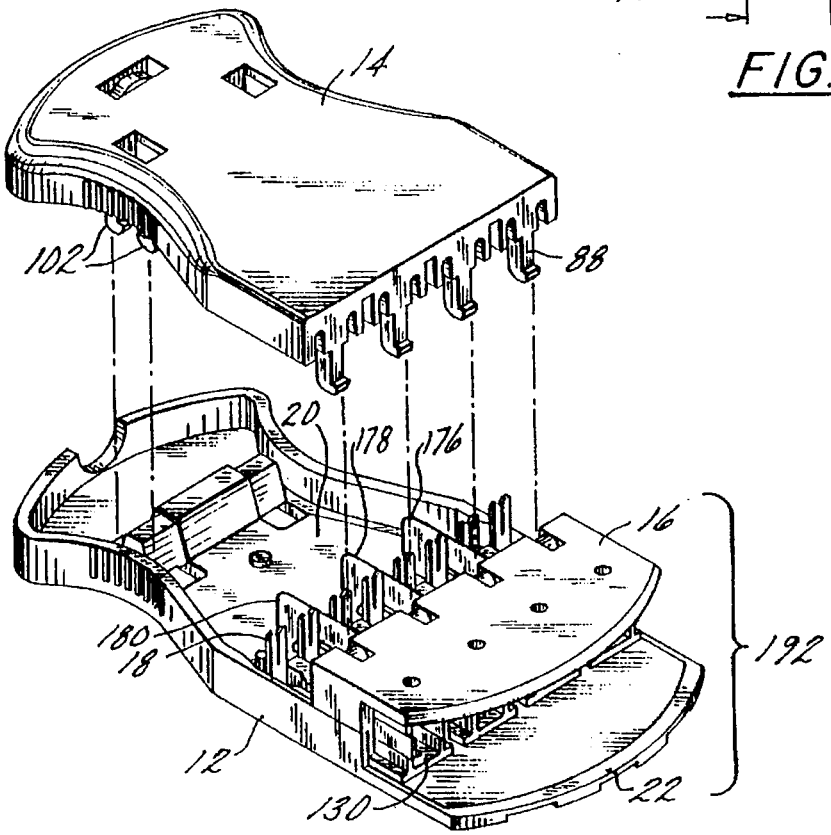
FIG. 35 is an exploded view of the cover housing, base housing, contact insulator, contacts and shield prior to the final assembly of the cover housing to the base housing and contact assembly.
Figure 36:
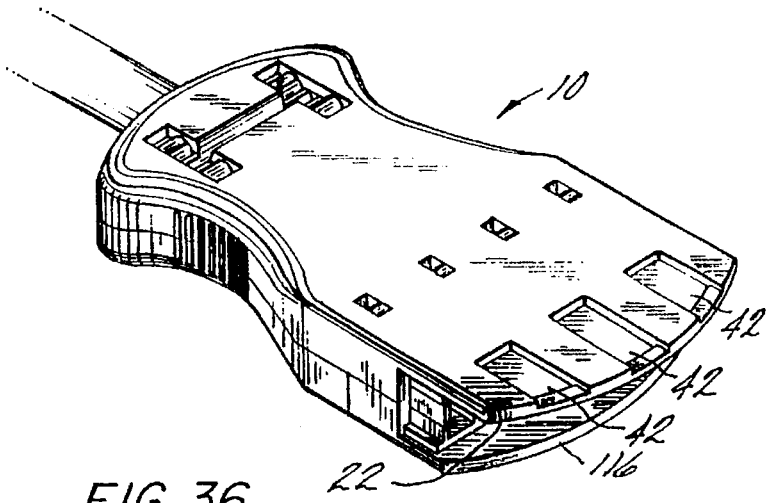
FIG. 36 shows a completed assembled patch connector in accordance with the present invention oriented for installation just prior to connection to a connector block (not shown)
Figure 37:
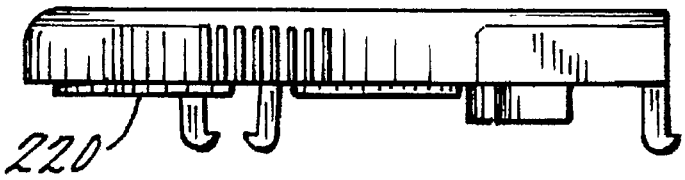
FIG. 37 is a side elevation view of an alternate four pair connector.
Figure 38:
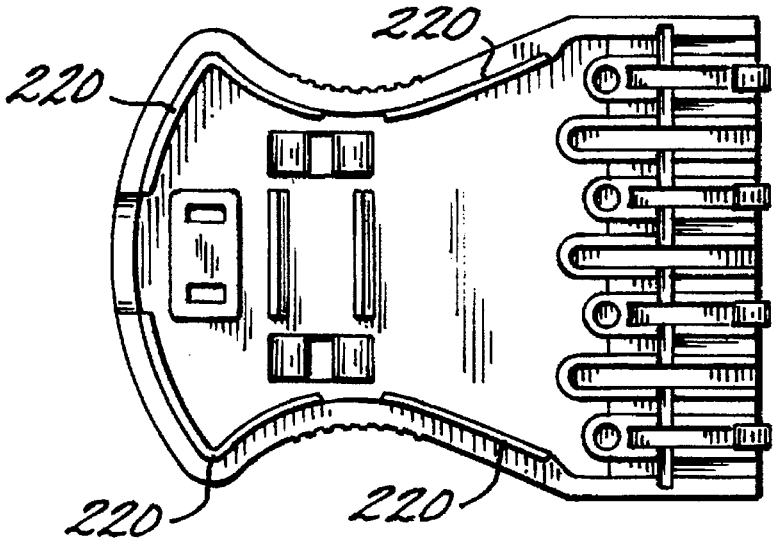
FIG. 38 is an underside plan view of the cover of the alternate four pair connector.
Figure 39:
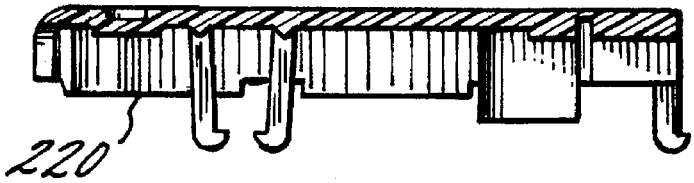
FIG. 39 is a cross section of FIG. 38 taken along section line 39—39.

Turning now to FIGS. 34–36, assembly of the four pair patch connector of the present invention will now be described. It will be appreciated that the patch connector of the present invention may either be field terminated or may be factory terminated. In either case, prior to termination of the patch connector to a cable, a subassembly 192 (best shown in FIG. 35) is first assembled comprising base 12, metal shield 20, contact insulator housing 16 and a plurality of contacts 18. As mentioned hereinbefore, contact insulator housing 16 is snap-locked onto base 12 using the four resilient detents 44 which are passed through openings 90 and snap-locked onto ledge 126 as clearly shown in FIG. 4. Terminals 18 are passed through the channels 130 and mated with contact housing 16 as described hereinbefore. After assembly retention bump 156 on surface 158 of contact 18, provides a friction fit with side walls of openings 130 of insulator housing 16 in order to prevent movement if contacts 18 relative to housing 16 during transit and handling. Insulation displacement forks 148 of contacts 18 protrude upwardly at 90° with respect to surface 25 of contact housing 16.

Referring now to FIG. 34, after the subassembly 192 has been assembled, a cable 194 is positioned on cable tie holding structure 110 and a cable tie 196 of known construction extends through the openings in cable tie structure 110 to firmly grip and hold cable to upper housing 14. The outer jacket of a portion of cable 194 is removed to reveal an optional cable shield (in those cases where shielded twisted pair cable is being utilized). Cable shield 198 rests on cable supports 108. Exiting from the end of cable shield 198 are one or more (e.g., four) pairs of twisted pair wire 200 which lead to eight individual wires 202. Each wire 202 is positioned in a respective wire groove 92 and is retained therein through a friction fit between each wire conductor in the groove. Any wire extending outwardly of upper housing 14 is then trimmed.

Next, as shown in FIG. 35, upper housing 14 is positioned over lower housing 12 so that the pairs of mutually facing detents 100 and 102 will align with and be received by corresponding openings 64 in lower housing 12. In addition, the four detents 88 which extend downwardly from upper housing 14 are positioned to be received by correspondingly aligned openings 124 in contact housing 16 as best shown in FIG. 4. It will be appreciated that each detent 88 from housing cover 14 resiliently snap-locks to and engages surface 25 of insulator housing 16 as described hereinbefore. As housing cover 14 is snap-lockedly engaged to housing base 12 and insulator housing 16, the insulation displacement connectors 18 will electrically and mechanically engage to each individual conductor 202 so that all the wires have been fully terminated to the patch connector as shown in FIG. 36. Simultaneously shield tabs 176, 178 and 180 engage in cover receptacles 93 so as to provide optimum crosstalk isolation.

In summary, the patch connector of the present invention may be field or factory terminated as follows:

1. Cut cable 194 to desired length.
2. Strip cable jacket (preferably at least 1.5 in. (38.1 mm)) from cable end.

3. When used with shielded cable, remove shielding 190 and clear wrap from cable end leaving (preferably 0.50 in. (12.7 mm)) shielding exposed from the outer jacket forward.
4. Use cable tie 146 to secure outer jacket as shown. Trim cable tie end after tightening.
5. Lace pairs 202 into wire channels 92 in cover 14 maintaining twists as close as possible to channels.
6. Trim wire ends 202 flush with front of housing cover 14.
7. Align latches and press cover into housing base assembly until all latches are fully engaged. Use standard pliers if necessary.

The patch connector is now ready for testing and positioning onto a mating 110 connector. It will be appreciated that parallel grooves 42 insure proper alignment and polarity when mating onto a 110 connector. It will also be appreciated that in the final assembly, the arcuate edge 22 of lower housing 12 extends outwardly from the arcuate edge 116 of contact insulator housing 16. This assures that shield integrity is established between cables in the proper order. In particular, shield elements are connected before signal conductors are allowed to touch and the shield elements are disconnected after plug and socket signal connections are broken.

The patch connector in accordance with the present invention has many features and advantages. For example, the patch connector of this invention meets the transmission standards of TIA/EIA TSB-40 category 5 transmission requirements and can be field terminated or factory terminated to either 24 or 26 AWG (0.14–0.23 $mm^2$) stranded, shielded or unshielded, twisted pair cable. The fact that the four pair 110 patch plug of this invention is both category 5 compliant and field terminable is an extremely important feature of this invention.

The high performance patch connector of this invention utilizes internal pair shielding (e.g., shield 20) to significantly improve near-end crosstalk (NEXT) between pairs. Worst pair NEXT values for the patch connection and 110 connecting block combination is dramatically reduced providing category 5 transmission performance.

Field-termination has been made easy using the patch connector of this invention by simply configuring the wires into the housing cover and snapping the cover into the housing base. The wires are automatically terminated to the insulation displacement contacts. A cable tie is included at the rear of the plug for securing the cable in place while configuring the pairs and snapping the housing together. The cable tie also provides a primary strain relief for the outer cable jacket.

The housing cover 14 has been specifically designed so that trimming wires prior to termination is quick and easy.

When the patch plugs of the present invention are used with shielded cable, the internal plug shield may be used to provide a ground path from the cable shield to the front of the plug where a make first/break-last ground connection can be made.

It will be appreciated that while the patch connector of the present invention has been described with regard to a four pair patch, the present invention may also be configured in any other required configuration, including one, two or three pair configurations. Similarly, while a cable has been shown being terminated to the patch connector of this invention, it will be appreciated that a modular plug may also be used which would be positioned at the rear of the housing and be wired to each of the contacts 18 in a known manner. Finally, in order to meet the category 5 performance specifications, cable 194 would of course, also need to meet the category 5 transmission requirements.

In addition, cover and base housings may be selectively coated with conductor material to further enhance shield effectiveness with respect to electromagnetic emissions at very high frequencies (for example, over 100 Hz).

In an alternate embodiment (illustrated in FIGS. 37, 38 and 39) of the four pair connector described in detail above, a seal 220 is provided extending from upper housing 14 in the direction of and positioned to rest within base housing 12. Seal 220 must preferably extend from inside arcuate surface 104 to beyond upper mating edge 222. When upper housing 14 is engaged with base housing 12 as hereinbefore described, seal 220 will extend over the seam between 12 and 14. When the housing sections 12, 14 are conductively coated, the seal 220 enables superior shielding of the connector.

Another alternative feature of the four pair connector on the surface 32 of base 12 is the inclusion of a depression 224 having undercuts 226 and a polarity bump 228. Depression 224 also includes its own molded in arrow 229. As will be appreciated from FIG. 40 the shape of depression 224 is predominantly oval and the shape includes bump 228 to prevent inadvertent misdirection of icon 230 (FIG. 99), which is intended to be engaged with depression 224 in one direction only. Orienting arrow 232 should always point toward the connection.

As will be appreciated from FIGS. 99–102 the icon 230 includes lugs 234 which engage undercuts 226. The icon is preferably color coded and displays chamfered edge 236 on top surface 238 and chamfered edge 240 on bottom surface 242. The oval icon will be employed herein to indicate by color particular information about the connector.

Figure 43:
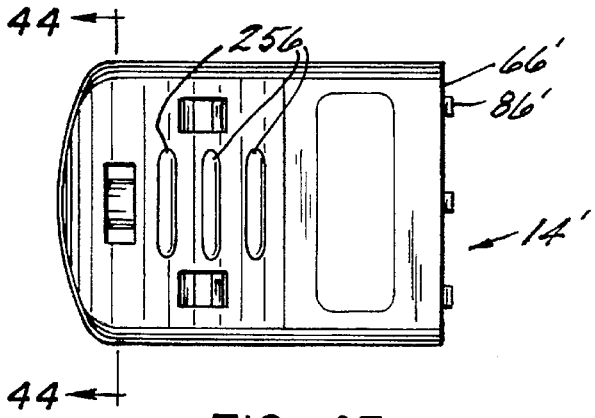
FIG. 43 is a plan view of the cover of a three pair embodiment.
Figure 45:
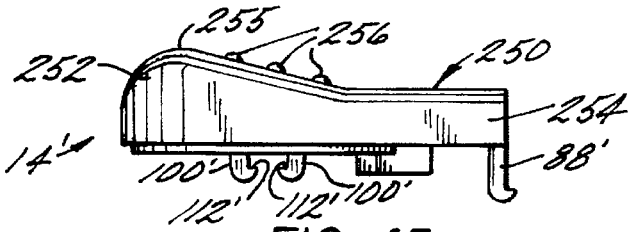
FIG. 45 is a side elevation view of the cover of the three pair embodiment.
Figure 48:
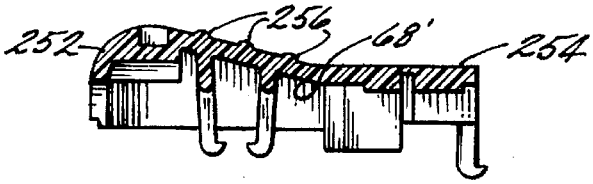
FIG. 48 is a cross section of FIG. 46 take along section line 48—48.
Figure 47:
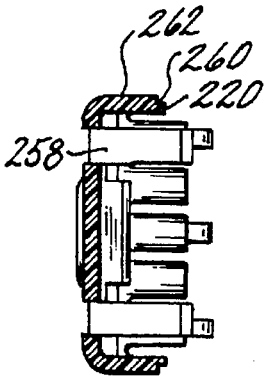
FIG. 47 is a cross section of FIG. 46 taken along section line 47—47.
Figure 46:
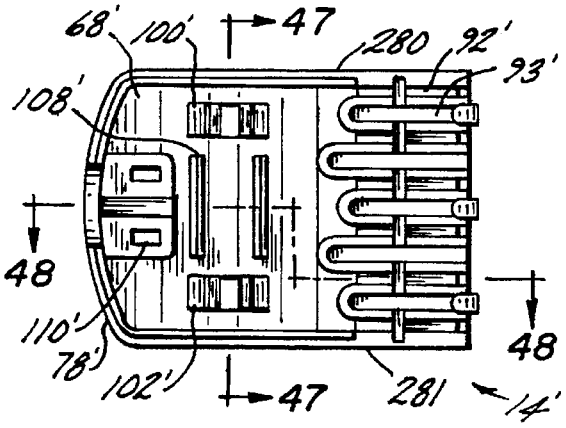
FIG. 46 is an underside plan view of the cover of the three pair embodiment.
Figure 49:
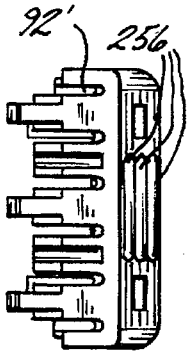
FIG. 49 is a front end view of the cover of the three pair embodiment.
Figure 55:
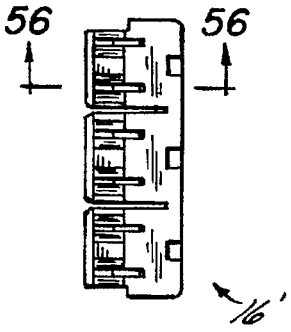
FIG. 55 is a rear end view of the insulator of the three pair embodiment.
Figure 50:
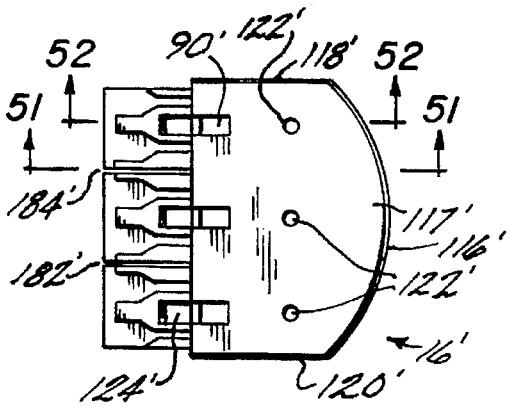
FIG. 50 is a plan view of a three pair insulator of the invention.
Figure 53:
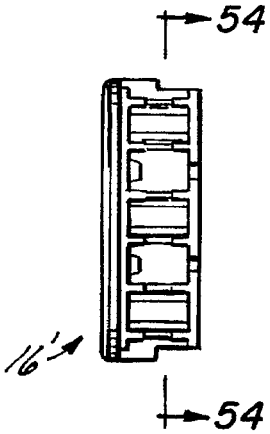
FIG. 53 is a front end view of the insulator of the three pair embodiment.
Figure 52:
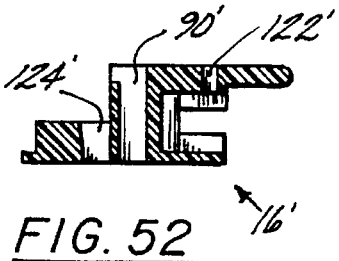
FIG. 52 is a cross section of FIG. 50 taken along section line 52—52.
Figure 54:
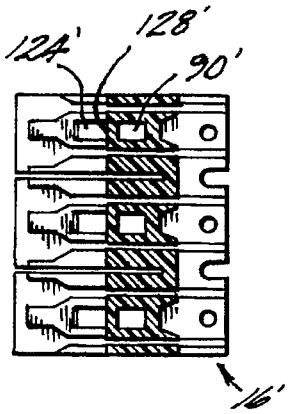
FIG. 54 is a cross section of FIG. 53 taken along section line 54—54.
Figure 58:
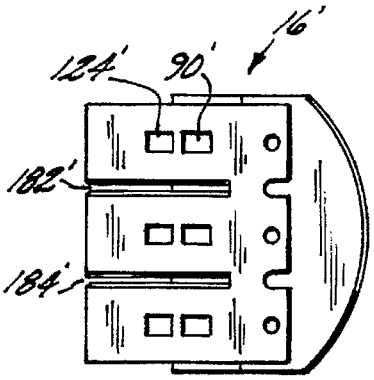
FIG. 58 is an underside plan view of the insulator of the three pair embodiment.
Figure 51:
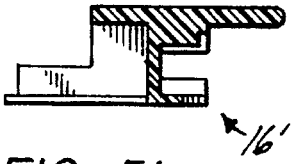
FIG. 51 is a cross section of FIG. 50 taken along section line 51—51.
Figure 56:
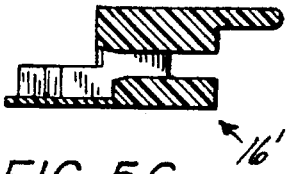
FIG. 56 is a cross section of FIG. 55 taken along section line 56—56.
Figure 57:
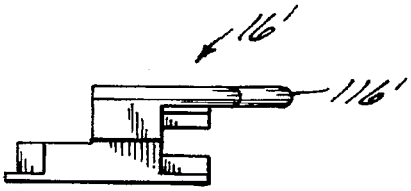
FIG. 57 is a side elevation view of the insulator of the three pair embodiment.
Figure 62:
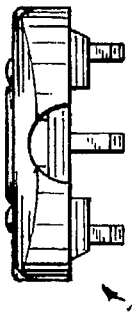
FIG. 62 is a rear end view of FIG. 59.
Figure 59:
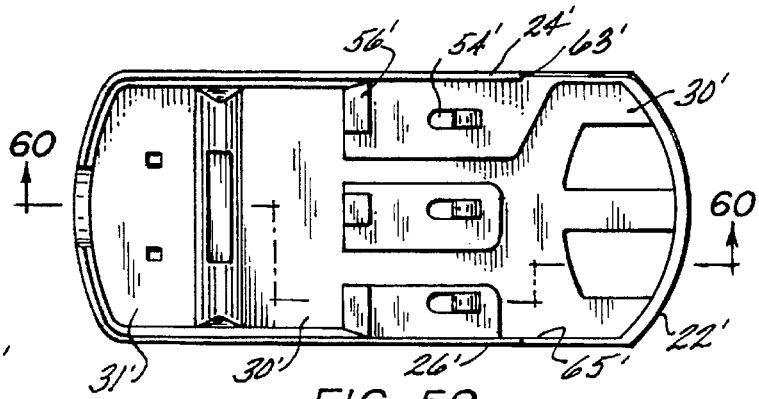
FIG. 59 is an interior plan view of the base of the three pair embodiment.
Figure 61:
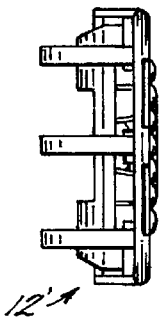
FIG. 61 is a front end view of FIG. 59.
Figure 60:
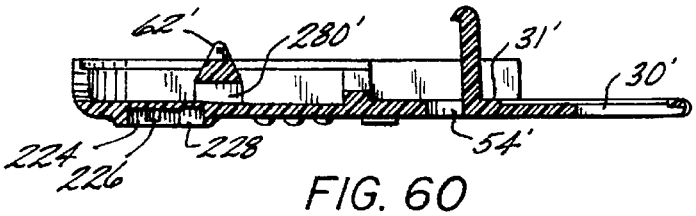
FIG. 60 is a cross section view of FIG. 59 taken along section line 60—60.

Referring generally now to FIGS. 43–117 three other embodiments of the connector of the invention are illustrated. In each of the three embodiments specifically one, two, and three pair embodiments, some of the structures are the same as those described in detail hereinabove with respect to the four pair connector of the invention. In order to improve clarity of discussion, as well as to point out specific distinctions in the structure of the total of four preferred embodiments the numbering of the three following embodiments will be numbered using "" for parts designations sufficiently similar to the four pair embodiment.

In the three pair embodiment illustrated in FIGS. 43–70A it will be appreciated that the arcuate shaped finger areas of the four pair configuration have been removed. Instead the three pair connector (and two pair connector discussed hereunder) exhibits a cover housing 14' which is taller in a rear end 252 of the cover than at a from end 254 of cover housing 14'. The cover housing 14' becomes taller gradually to provide a ramped appearance which provides a good surface to bear on should a user desire to remove the connector from the complimentary connector (not shown). The bearing surface 255 also includes a plurality of gripper nublines 256 (nublines are elongated raised structures providing increased friction).

As will be appreciated by one of skill in the art, most of the internal features of cover 14' are as described above with respect to the four pair arrangement with the exception that grooves 92 and separation slots 93 are fewer.

The three pair connector embodiment most preferably includes seal 220 extending directly from edge 260 of wall 262.

Referring now to housing base 12' (FIGS. 60–65) it will be appreciated that many of the concepts of the four pair connector discussed hereinabove are embodied in the three pair arrangement as well.

Figure 63:
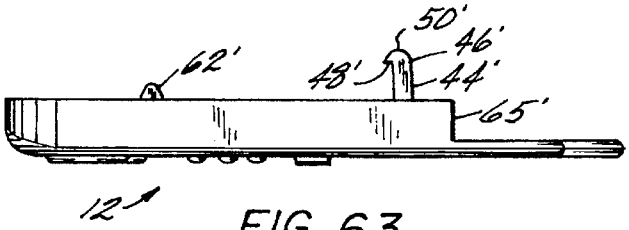
FIG. 63 is a side elevation view of the base of the three pair embodiment.
Figure 64:
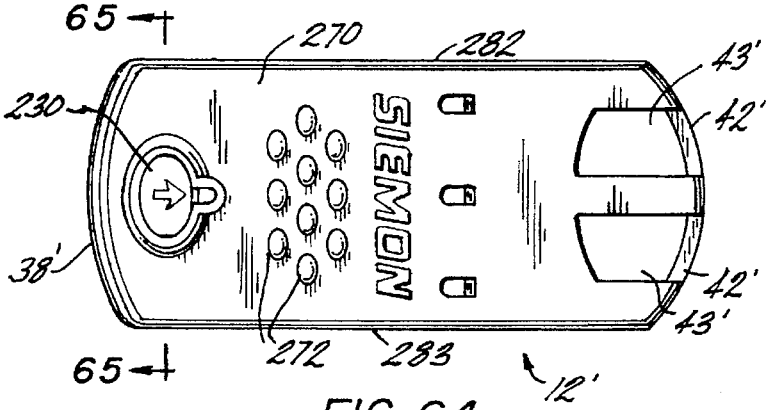
FIG. 64 is a plan view of the base of the three pair embodiment.
Figure 65:
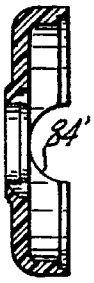
FIG. 65 is a cross section view of FIG. 64 taken along section line 65—65.
Figure 66:
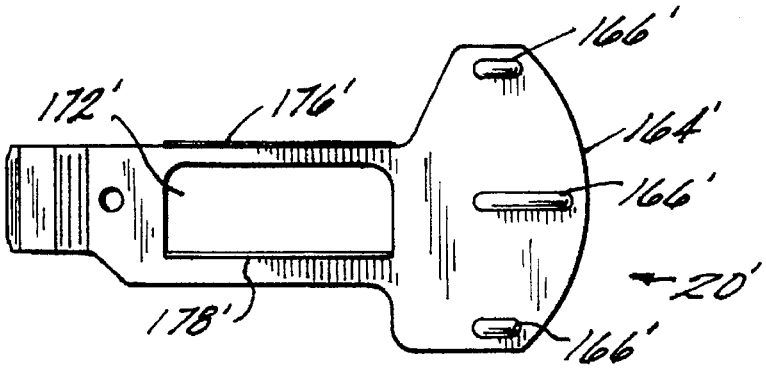
FIG. 66 is a top plan view of the shield of the three pair embodiment.
Figure 67:
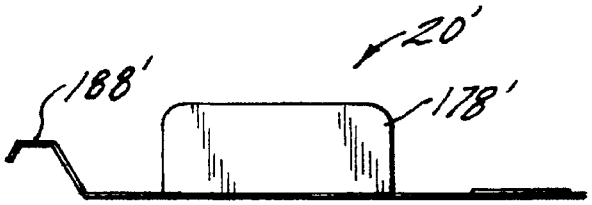
FIG. 67 is a side elevation view of the shield of the three pair embodiment.
Figure 68:
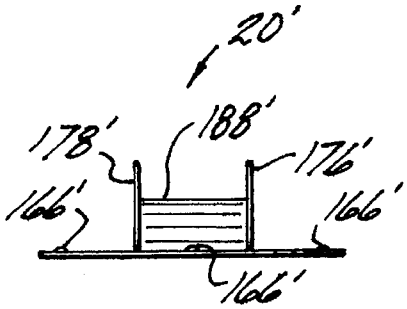
FIG. 68 is a front end view of the shield of the three pair embodiment.
Figure 69:
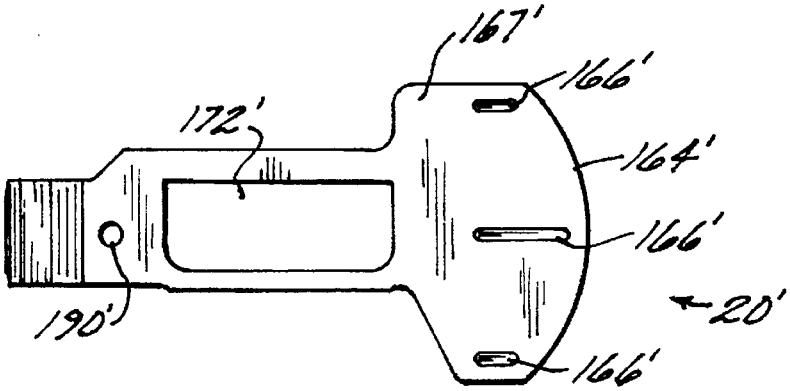
FIG. 69 is a bottom view of the shield of the three pair embodiment.
Figure 70:
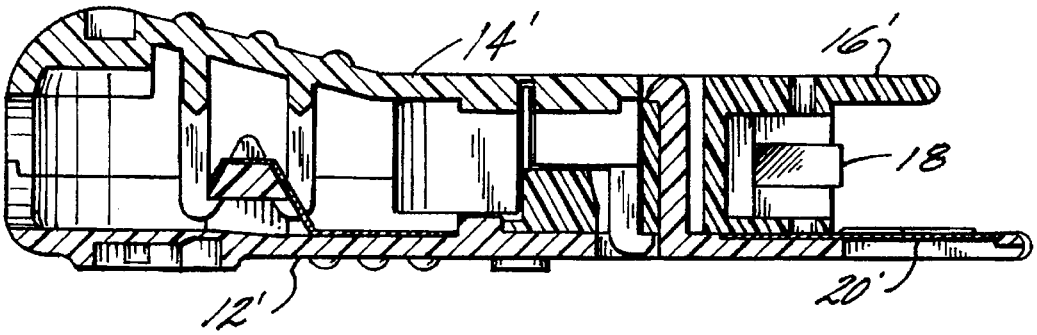
FIG. 70 is a cross section view of a fully assembled three pair connector taken along the section line (illustrated in the base) 60—60 of FIG. 59.
Figure 70A:
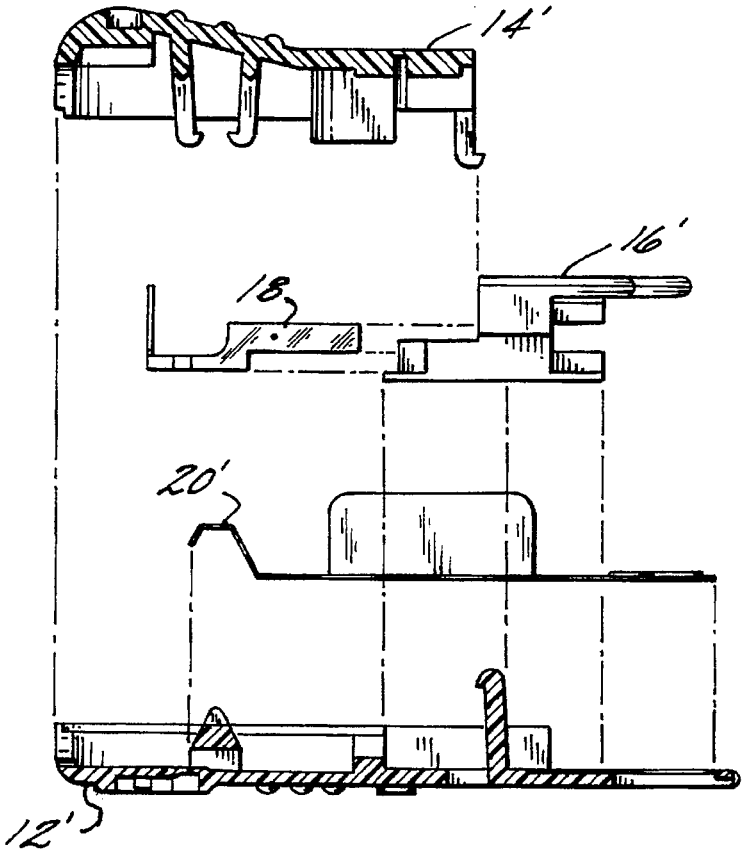

Referring directly to FIG. 63 the external surface 32' of base 12' includes a depression 224 identical to the one on base 12 of the four pair connector. Further discussion thereof is therefore not required here.

Included on surface 32' for connection and disconnection purposes are a plurality gripper nubules 272.

Another difference from the four pair connector is the two shield openings 43' which correspond to the three openings 43 in the four pair connector and which are set behind webs 42'. Whereas in the four pair connector the openings 43 number three, equally spaced across the arcuate front, openings 43' of the three pair connector number only two which are also equally spaced across the arcuate front. Openings 43' provide access to metallic shield 20' from outside surface 32' for the purpose of making electrical connections with a plug receptacle (not shown). The outside surface of webs 42' is stepped inwardly from outer surface 32' and is approximately aligned with inside surface 30' so as to allow connections to be made to outer surface 167' of metal shield 20' with minimum mechanical interference and without excessive deformation of mating contacts.

At a distance of about one third of the overall length of base housing 12' from front surface 22' there are three detents 44' that extend upwardly and flexibly from inside planar surface 31'. The ends of each detent 44' include a radius 46' which leads to an angled insertion surface 50' and finally terminates at a lip 48'. Insertion surface 50' is at preferably a 60° angle relative to inside surface 31'. The underside lip 48' preferably dips downwardly 2° toward inside surface 31' as it extends from the base of detent 44' to surface 50'. Adjacent to the three detents 44' are three detent openings 54' which are rectangular at one end and radiused at the other end. The three detents 44' are designed to secure insulator housing 16' to base section 12' as will be discussed hereinafter.

About midway of the overall length of base housing 12', there are three spaced pads 56' that extend upwardly a short distance from inside surface 31'.

Between arcuate rear surface 38' and spaced pads 56', there is a "V" shaped protrusion 62' that both supports shield 20' in position and also acts as a means of shield termination when a cable shield is present, as a secondary strain relief for the patch cable, and as a stiffening rib to support the two sets of double detents 100' and 102' that extend from upper housing cover 14'. "V" shaped protrusion 62' extends upwardly from inside surfaces 31' and 30'. Adjacent to each end of "V" shaped protrusion 62' are two undercuts 280' to receive the detents extending from upper housing 14' in snaplocking engagement.

Arcuate rear surface wall 38' and straight side walls 24', 26' extend upwardly from inside surfaces 30' and 31' the same distance as the mating side walls of upper housing cover 14' (to be discussed hereinafter). The height of straight side walls 24', 26' abruptly decreases at vertical edges 63', 65', respectively to match the plane of inside surface 31'. The length of the walls just described are equal to the total length of the walls of upper housing cover 14' combined with the side walls of the insulator housing 16' (also to be discussed hereinafter).

Returning now to upper housing 14' a more detailed description of the structure thereof is provided. Rear arcuate segment 78' has an oblong, (not shown) or a semi-circular cutout 82 sized to receive the outer jacket of a cable (see FIGS. 44, 62 and 65). When upper housing 14' is assembled to housing base 12', semicircular cutouts 82' and 84' form a smooth full opening to allow the passage of the cable to the interior of housing base 12' and upper housing 14'. It should be noted that when housing cover 14' is assembled to base housing 12', the side walls 280, 281 and 78' of housing cover 14' match up smoothly with side walls 282, 283 and 38' of base housing 12', respectively.

Front edge and face 66' of upper housing 14' is a straight planar surface except for the slight protrusion of three detent lips 86'. Lips 86' are integral with detents 88' which extend upwardly from front edge and face 66'. Detents 88' pass through rectangular holes 90' (shown in FIG. 54) of insulator housing 16' (details of insulator housing 16' to be discussed hereinafter) so as to lock together when the sub-assembly (e.g., base housing 12', and insulator housing 16' along with a plurality of connector contacts 18 and metal shield 20') is complete.

Extending rearwardly from front edge and face 66' are a plurality of grooves 92' (which number six in the three pair embodiment) sized to accept standard single conductor telecommunications wire complete with insulation (conductors being similar to those shown in FIG. 34 in the four pair embodiment) preferably stranded size AWG 26–24. Grooves 92' preferably have a semi-circular base. About a ¼" distance back from front edge and face 66' there are a plurality of transverse slots 94' sized to receive the self terminating ends 96 of contacts 18 (contacts 18 are described in more detail hereinabove in conjunction with the four pair plug and are the same in the three, two and one pair embodiments).

Extending rearwardly from front face 66', and positioned between even numbers of transverse slots 92", are pair separation slots 93'. It will be appreciated that pair separation slots 93' are positioned and sized in such a way as to align and receive tabs 176' and 178', of metallic shield 20' (to be discussed hereinafter). It will be appreciated that the length of pair separation slots 93', is greater than the length of grooves 92', to assure pair separation to the greatest extent possible so as to reduce crosstalk and optimize performance. The housing wall that encloses slot 93' physically extends out to provide a physical barrier between pairs. This barrier physically keeps untwisted tip and ring conductors away from adjacent pairs and assures that the parallel portions of adjacent pairs are separated by a shield.

Extending from the inside area of cover 14' are detents 100', 102', one set on either side of the patch connector which extend from inside surface 68'. Detent sets 100', 102' are inserted into the two sets of detent slots 280' of base housing 12' when cover housing 14' is assembled to base housing 12'. Located between detent sets 100', 102' are two spaced rectangular cable support ribs 108' that extend a short distance upwardly from inside surface 68'. Cable support ribs provide a secondary strain relief mechanism for the outer cable jacket by clamping the cable between the "V"-shaped protrusion and the ribs. Just in front and inside of rear arcuate segment wall 78' is a cable tie holding structure 110' for receiving a cable tie (see FIG. 46). Each detent set 100', 102' comprises two detents in spaced, opposing relation which extend from inside surface 68' preferably at an angle of 3° toward each other. The lip 112' preferably dips 6° from the horizontal. The angular face 114' is preferably at a 57° angle from the horizontal and rounding the outside edges of the detents with small radii is preferred. The three detents 88' preferably have a penetrating face angle of 30° from the vertical.

It will be appreciated that the contacts 18 disposed therein are identical to that of the four pair connector but for the fact that fewer contacts are employed. Because fewer contacts are employed the resulting insulator 16' is less wide than the four pair connector and contains structure for receiving only six contacts for three pairs. Insulators 16' also differ in that there are fewer latch openings 90' fewer polarization features (FIG. 53), fewer shield openings 182', 184'(FIG. 58) and fewer holes 122'.

Referring now to FIGS. 66–69, a metal shield 20' will now be described. Shield 20' is preferably one-piece and comprises a stamped metal part having an overall shape which conforms to the shape of inner surface 30' of main body or base section 12'. A front end 164' of shield 20' has an arcuate shape commensurate with the arcuate shape 22' of main body 12'. Extending rearwardly, from proximate to the front arcuate edge 164' are three parallel spaced ribs 166' that protrude above inside surface 167' of metallic shield 20'. Parallel ribs 166' are sized and positioned for the purpose of providing redundant positive connection means with a mated conductor, preferably one whose surface is curved and perpendicular to ribs 166', so as to result in optimum Herztian stress on the connection interface. These ribs also define the primary contact surface with the side of the 110 connector so as to prevent potential jamming of lead edge 164' on lower recessed edges of the 110-style connector. It will be appreciated that additional parallel ribs may be provided that protrude in the opposite direction (above outside surface 167'), so as to align with openings 43' in housing base 12'. These additional ribs (not shown) may also be used to optimize integrity of the shield connections that are made through openings 43' in housing base 12'. The center portion of shield 20' defines a narrowed central section for shield 20'. Within that narrowed section is a rectangular opening 172'. Extending upwardly from one edge of the narrowed central section and from the corresponding edge of opening 172' are two spaced and parallel transverse shield tabs 176', 178', respectively. It will be appreciated that shield tabs 176' and 178' are located in a position so as to be received in respective slots 182' and 184' located in contact insulator housing 16' (see FIG. 58). As will be discussed hereinafter, shield tabs 176' and 178' perform the important function of providing electrical isolation between adjacent pairs positioned within the contact insulator housing 16'. Shield 20' terminates at a handle portion 188' which has a configuration commensurate with the V-shaped protrusion 62' in base 12'. Between handle portion 188' and opening 172' shield 20' has a stepped plan section with an aperture 190' centrally disposed therethrough. This is best shown by analogy to FIG. 4 wherein the handle 188 is shown being seated on V-shaped protrusion 62. Assembly of the patch connector of the three, two and one pair embodiments are as the four pair embodiment is. Therefore, the discussion of assembly hereinbefore is well suited to the three and two pair embodiments, however the one pair does not use a cable tie and therefore primary cable strain relief is achieved as described on p. 32.

The two pair embodiment of the present invention is substantially similar to the three pair embodiment set forth immediately above, with the exception that the overall size of the two pair embodiment is smaller in width. The reduction in overall size requires some changes in structure due to available space. Structure that is distinct from that set forth above will be discussed hereunder first with respect to the two pair embodiment and subsequently with regard to the one pair embodiment. Structures that are identical to that of the three pair embodiment will not be discussed here and reference is made to the discussion above for equivalent structure.

In the two pair embodiment of the present invention, referring to FIGS. 71–98 it is easily understood by one of skill in the art that but for a reduction in the number of structures commensurate with both the smaller overall dimensions of the connector and the number of conductors contemplated for use, the two pair embodiment is the same as the three pair embodiment. Among structures reduced in number are separation slots 93' and grooves 92', through holes 90' and 124' and the insulator 16" defines fewer through passages for contacts 18. There are also fewer detents 44' and 88' as can be ascertained by a brief review of the drawing FIGS. 71–98. It will also be noted that there is only one opening 43' and associated web 42' in the two pair embodiment.

Distinctions include detent sets 100' and 102' which in the smaller overall size constraints of the two pair connector are required to be thinner at the lip 112' end than at the area of emanation 258 (see FIG. 75) from interior surface 68' of cover 14". The reduced thickness at the lip 112' end of detents 100' or 102' is necessary due to size constraints however by making the area of emanation 258 thicker, the detent is given more strength without creating size difficulties at the insertion point. Another benefit associated with the progressively narrower structure of detent sets 100' or 102' is that the mold designed to make the detents is stronger and more durable. This reduces overall cost of molding thus rendering the product more economical.

Referring now to FIGS. 93–96 shield 20" evidences different construction due to the restricted space it must fit within. It is noted that shield 20" fits within the intended space substantially like that of the heretofore described embodiments.

Shield 20" is of one piece construction as those above and includes front end 164' and conforms to inner surface 30' of base section 12". The shape of the shield 20" however differs from those above due to space limitations and intended purpose. As will be appreciated by one of skill in the art, narrow central region is much narrower than those described above, does not contain any rectangular openings and only employs one transverse shield tab 176". This embodiment also employs cutout 168" to traverse structures in housing base 12". In other respects, the two pair embodiment explanation is substantially the same as the three pair embodiment.

Referring now to FIGS. 103 to 117, the one pair embodiment of the patch connector is illustrated in detail. Focusing first on FIGS. 103 to 107 the one pair, cover 14'" contains a detent 88'" at first edge 66'" and detent sets 100'" and 102'" which bind the cover 14'" to base housing 12'".

The housing base 12'" however is different from the foregoing embodiments in that it is of single construction with the contact insulator housing of the previous embodiments. Therefore it will be noted that no detent 44 exists in this embodiment. It will be appreciated by one of skill in the art that the construction of what would be a separate insulator housing in the four, three or two pair embodiment is the same as it is in the one pair embodiment. The sole difference being that the entire insulator is molded as one piece with housing base 12'".

Another distinction from the two or three pair connectors is that detent sets 100'" and 102'" are visible through detent slots 64' which are notably absent in the two and three pair connectors.

No shield is provided in the preferred embodiment of the one pair connector of the invention because there is no need to shield between adjacent pairs to reduce crosstalk as only one pair is employed.

The one pair embodiment does not include the icon depression employed in the other embodiments, however, a molded in "top" symbol 200 (FIG. 114) is provided with an arrow as illustrated.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A patch connector comprising:

(1) a sub-assembly, said sub-assembly comprising;

(a) an insulative housing base having a front end, an opposed rearward end, an inner surface, an opposed outer surface and sidewalls extending along at least a portion of an outer periphery of said housing base;

(b) an insulating contact housing attached to said inner surface of said housing base, said contact housing having a front end, an opposed rearward end and a plurality of chambers extending through said contact housing between said front end and said rearward end;

(c) a plurality of contacts, each contact having a front end extending in a respective one of said chambers and a rearward end terminating at an insulation displacement connector; and (d) a shield, said shield providing electrical isolation to selected contacts or groups of contacts; and (2) an insulative housing cover, said housing cover having a substantially straight planar front end, an opposed rearward end, an inner surface and an opposed outer surface, said inner surface including retaining structure for selectively retaining individual conductors in spaced relation, said retaining structure having rounded ends at a rearward portion thereof to facilitate feeding individual conductors into the retaining structure, and said housing cover including engagement structure for attaching said housing cover to said sub-assembly wherein selected conductors retained in said housing cover are terminated onto selected ones of said contacts.

2. The connector of claim 1 wherein:

said from ends of said housing base and contact housing each have an arcuate shape.

3. The connector of claim 1 wherein:

said front end of said housing base extends outwardly beyond said front end of said contact housing.

4. The connector of claim 1 wherein said front end of said contact housing includes:

a front face having a receptacle structure for mating to a 110-type terminal block; and a pair of outer edge surfaces extending outwardly of said front face.

5. The connector of claim 4 wherein:

at least one of said outer edge surfaces has an arcuate shape.

6. The connector of claim 4 including:

spaced, aligned openings through said pair of outer edge surfaces for mating with a mating structure on a 110 terminal block.

7. The connector of claim 1 wherein:

first mating structure for snap-lockedly attaching said contact housing to said housing base.

8. The connector of claim 6 wherein said first mating structure comprises:

at least one resilient spaced first detent extending upwardly from said inner surface of said housing base; and at least one spaced first opening in said contact housing, each first opening being positioned to receive a respective first detent, a first lip being associated with each first opening for engagement to a first detent.

9. The connector of claim 1 including:

polarizer on said outer surface of said housing base for interfacing with a 110 connector.

10. The connector of claim 9 wherein:

said polarizer comprises a plurality of spaced grooves extending from said front end towards said rearward end.

11. The connector of claim 1 wherein said shield comprises:

a metal plate supported at said inner surface of said housing base.

12. The connector of claim 11 wherein said metal plate further includes:

a plurality of upwardly extending shield tabs for electrically isolating pairs of said contacts.

13. The connector of claim 12 wherein said plate further includes:

a plurality of openings formed through said plate with at least some of said shield tabs extending from selective edges of said openings.

14. The connector of claim 13 wherein:

said plate is one-piece and has a shape commensurate with the shape of at least a portion of said inner surface of said housing base.

15. The connector of claim 11 wherein:

said shield tabs extend upwardly through respective slots in said contact housing.

16. The connector of claim 1 wherein said engagement structure includes:

a plurality of resilient spaced second detents extending downwardly from said front end of said housing cover; and a plurality of spaced second openings in said contact housing, each second opening being positioned to receive a respective second detent, a second lip being associated with each second opening for engagement to a second detent.

17. The connector of claim 8 wherein said engagement structure includes:

a plurality of resilient spaced second detents extending downwardly from said front end of said housing cover; and a plurality of spaced second openings in said contact housing, each second opening being positioned to receive a respective second detent, a second lip being associated with each second opening for engagement to a second detent.

18. The connector of claim 17 wherein:

a wall separates respective ones of said first and second openings with said first and second lips defining opposed upper and lower edges of said wall.

19. The connector of claim 1 wherein said engagement structure includes:

two spaced groups of third detents extending downwardly from said inner surface of said housing cover, each group of third detents comprising a pair of inwardly facing detents; and mating apertures through said housing base for receiving and mating with said third detents.

20. The connector of claim 16 wherein said engagement structure further includes:

two spaced groups of third detents extending downwardly from said inner surface of said housing cover, each group of third detents comprising a pair of inwardly facing detents; and mating apertures through said housing base for receiving and mating with said third detents.

21. The connector of claim 1 wherein:

said housing cover is co-planar with and has substantially the same thickness as said contact housing.

22. The connector of claim 1 wherein:

said housing cover and housing base cooperate to define a narrowed arcuate gripping portion.

23. The connector of claim 1 wherein:

said housing cover and housing base each have aligned arcuate openings which cooperate to provide a pass through space for a cable.

24. The connector of claim 1 wherein:

said patch connector meets the TIA/EIA TSB-40 Category 5 transmission requirements when terminated to Category 5 compliant cable.

25. The connector of claim 1 wherein each of said contacts includes:

a stopper for preventing over-insertion of said insulating contact housing during assembly.

26. The connector of claim 1 wherein each of said contacts includes:

a friction fit structure for preventing movement of said contact in said insulating contact housing.

27. The connector of claim 1 wherein said shield includes:

at least one rib protruding from one surface of said shield for providing a redundant positive connection.

28. A patch connector comprising:

(1) a sub-assembly, said sub-assembly comprising;

(a) an insulative housing base having a front end, an opposed rearward end, an inner surface, an opposed outer surface and sidewalls extending along at least a portion of an outer periphery of said housing base;

(b) an insulating contact housing attached to said inner surface of said housing base, said contact housing having a front end, an opposed rearward end and a plurality of chambers extending through said contact housing between said front end and said rearward end; and (c) a plurality of contacts, each contact having a front end extending in a respective one of said chambers and a rearward end terminating at an insulation displacement connector; and (2) an insulative housing cover, said housing cover having a substantially straight planar front end, an opposed rearward end, an inner surface and an opposed outer surface, said inner surface including retaining structure for selectively retaining individual conductors in spaced relation, said retaining structure having rounded ends at a rearward portion thereof to facilitate feeding individual conductors into the retaining structure, and said housing cover including engagement structure for attaching said housing cover to said sub-assembly wherein selected conductors retained in said housing cover are terminated onto selected ones of said contacts.

29. A patch connector comprising:

a plurality of contacts, each having a contact end and an end receptive for connection to a conductive wire;

a housing adapted for ready field termination of a cable to said connector, said adaption including a straight planar front edge face and rounded division structures between adjacently disposed wires, said housing further having said contacts disposed therein, said housing being matable with a 110 terminal block, wherein said contact end of said contacts are receptive for electrical connection with terminals of the 110 terminal block; and a shield for providing electrical isolation to selected contacts or groups of contacts.

30. A patch connector comprising:

(1) a sub-assembly, said sub-assembly comprising;

(a) an insulative housing base having a front end, an opposed rearward end, an inner surface, an opposed outer surface and sidewalls extending along at least a portion of the outer periphery of said housing base;

(b) an insulating contact housing attached to said inner surface of said housing base, said contact housing having a front end, an opposed rearward end and a plurality of chambers extending through said contact housing between said front end and said rearward end;

(c) a plurality of contacts, each contact having a front end extending in a respective one of said chambers and a rearward end terminating at an insulation displacement connector; and (d) a shield, said shield providing electrical isolation to selected contacts or groups of contacts; and (2) an insulative housing cover, said housing cover having a front end, an opposed rearward end, an inner surface and an opposed outer surface, said inner surface including retaining structure for selectively retaining individual conductors in spaced relation and said housing cover including engagement structure for attaching said housing cover to said sub-assembly wherein selected conductors retained in said housing cover are terminated onto selected ones of said contacts.

31. A patch connector comprising:

(1) a sub-assembly, said sub-assembly comprising;

(a) an insulative housing base having a front end, an opposed rearward end, an inner surface, an opposed outer surface and sidewalls extending along at least a portion of the outer periphery of said housing base;

(b) an insulating contact housing attached to said inner surface of said housing base, said contact housing having a front end, an opposed rearward end and a plurality of chambers extending through said contact housing between said front end and said rearward end; and (c) a plurality of contacts, each contact having a front end extending in a respective one of said chambers and a rearward end terminating at an insulation displacement connector; and (2) an insulative housing cover, said housing cover having a front end, an opposed rearward end, an inner surface and an opposed outer surface, said inner surface including retaining structure for selectively retaining individual conductors in spaced relation and said housing cover including engagement structure for attaching said housing cover to said sub-assembly wherein selected conductors retained in said housing cover are terminated onto selected ones of said contacts.

32. A patch connector comprising:

a plurality of contacts, each having a contact end and an end receptive for connection to a conductive wire;

a housing having said contacts disposed therein, said housing being matable with a 110 terminal block at one end thereof, wherein said contact end of said contacts are receptive for electrical connection with terminals of the 110 terminal block; and a shield for providing crosstalk isolation between to selected contacts or groups of contacts said 110 terminal block end of said housing allowing access to said shield while affording protection to said shield.

33. A patch connector comprising:

(1) a sub-assembly, said sub-assembly comprising;

(a) an insulative housing base having a front end, an opposed rearward end, an inner surface, an opposed outer surface and sidewalls extending along at least a portion of an outer periphery of said housing base, said housing base having a taller cross section at said rearward end than said front end to provide an angular gripping surface;

(b) an insulating contact housing attached to said inner surface of said housing base, said contact housing having a front end, an opposed rearward end and a plurality of chambers extending through said contact housing between said front end and said rearward end;

(c) a plurality of contacts, each contact having a front end extending in a respective one of said chambers and a rearward end terminating at an insulation displacement connector; and (d) a shield, said shield providing electrical isolation to selected contacts or groups of contacts; and (2) an insulative housing cover, said housing cover having a substantially straight planar front end, an opposed rearward end, an inner surface and an opposed outer surface, said inner surface including retaining structure for selectively retaining individual conductors in spaced relation, said retaining structure having rounded ends at a rearward portion thereof to facilitate feeding individual conductors into the retaining structure, and said housing cover including engagement structure for attaching said housing cover to said sub-assembly wherein selected conductors retained in said housing cover are terminated onto selected ones of said contacts.

34. The connector of claim 33 wherein said shield further includes: .

at least one upwardly extending shield tab for electrically isolating pairs of said contacts.

35. The connector of claim 34 wherein said shield further includes:

at least one opening formed through said shield with at least some of said at least one upwardly extending shield tab extending from selective edges of said at least one opening.

36. A patch connector comprising:

(1) a sub-assembly, said sub-assembly comprising;

(a) an insulative housing base having a front end, an opposed rearward end, an inner surface, an opposed outer surface and sidewalls extending along at least a portion of an outer periphery of said housing base, said housing base having a taller cross section at said rearward end than said front end to provide an angular gripping surface;

(b) an insulating contact housing attached to said inner surface of said housing base, said contact housing having a front end, an opposed rearward end and a plurality of chambers extending through said contact housing between said front end and said rearward end; and (c) a plurality of contacts, each contact having a front end extending in a respective one of said chambers and a rearward end terminating at an insulation displacement connector; and (2) an insulative housing cover, said housing cover having a substantially straight planar front end, an opposed rearward end, an inner surface and an opposed outer surface, said inner surface including retaining structure for selectively retaining individual conductors in spaced relation, said retaining structure having rounded ends at a rearward portion thereof to facilitate feeding individual conductors into the retaining structure, and said housing cover including engagement structure for attaching said housing cover to said sub-assembly wherein selected conductors retained in said housing cover are terminated onto selected ones of said contacts.

37. A patch connector comprising:

a plurality of conta, cts, each having a contact end and an end receptive for connection to a conductive wire;

a housing having said contacts disposed therein, said housing being matable with a 110 terminal block, wherein said contact end of said contacts are receptive for electrical connection with terminals of the 110 terminal block, wherein said housing includes a taller cross section at a rearward end than at a front end to provide an angular gripping surface;

a shield for providing crosstalk isolation between to selected contacts or groups of contacts.

38. A patch connector as claimed in claim 37 wherein said housing further includes a depression adapted for receiving a colored icon for color coding purposes.

39. A patch connector as claimed in claims 1, wherein said housing further includes a depression adapted for receiving a colored icon for color coding purposes.

40. A patch connector as claimed in claims 28, wherein said housing further includes a depression adapted for receiving a colored icon for color coding purposes.

41. A patch connector as claimed in claims 29, wherein said housing further includes a depression adapted for receiving a colored icon for color coding purposes.

42. A patch connector as claimed in claims 30, wherein said housing further includes a depression adapted for receiving a colored icon for color coding purposes.

43. A patch connector as claimed in claims 31, wherein said housing further includes a depression adapted for receiving a colored icon for color coding purposes.

44. A patch connector as claimed in claims 32, wherein said housing further includes a depression adapted for receiving a colored icon for color coding purposes.

45. A patch connector as claimed in claims 33, wherein said housing further includes a depression adapted for receiving a colored icon for color coding purposes.

46. A patch connector as claimed in claims 36, wherein said housing further includes a depression adapted for receiving a colored icon for color coding purposes.

47. A patch connector as claimed in claims 32, wherein said housing further includes a depression adapted for receiving a colored icon for color coding purposes.

* * * * *